US005585880A

United States Patent [19]

Saito

[11] Patent Number: 5,585,880

[45] Date of Patent: Dec. 17, 1996

[54] SOLID PROCESSING AGENT REPLENISHING APPARATUS FOR PROCESSING PHOTOSENSITIVE MATERIAL

[75] Inventor: Kaneo Saito, Tokyo, Japan

[73] Assignee: Konica Corporation, Tokyo, Japan

[21] Appl. No.: 387,466

[22] Filed: Feb. 13, 1995

[30] Foreign Application Priority Data

Feb. 15, 1994 [JP] Japan ..... 6-018570

[51] Int. Cl.[6] ..... G03D 3/02

[52] U.S. Cl. ..... 396/626; 221/231; 221/232

[58] Field of Search ..... 354/324; 221/231, 221/232, 277, 263; 137/268

[56] References Cited

U.S. PATENT DOCUMENTS 3,680,736 8/1972 Viessmann ..... 221/231 X
4,405,059 9/1983 Kull ..... 221/298
5,318,061 7/1994 Saito ..... 354/324 X
5,400,105 3/1995 Koboshi et al. ..... 354/324
5,438,383 8/1995 Nakashima ..... 354/324
5,452,045 9/1995 Koboshi et al. ..... 354/324

*Primary Examiner*—D. Rutledge
*Attorney, Agent, or Firm*—Frishauf, Holtz, Goodman, Langer & Chick

[57] ABSTRACT

In a device for supplying a solid processing agent from a container to a processing tank, when the solid processing agent is not supplied to the processing tank, the supply device blocks the solid processing agent at an inlet opening so as not to receive therein, and when the solid processing agent is supplied to the processing tank, the supply device receives the solid processing agent through the inlet opening and drops the solid processing agent through an outlet opening in the processing tank so that the solid processing agent does not remain in the supply device when the solid processing agent is not supplied to the processing tank.

15 Claims, 22 Drawing Sheets

SOLID PROCESSING AGENT REPLENISHING APPARATUS FOR PROCESSING PHOTOSENSITIVE MATERIAL

BACKGROUND OF THE INVENTION

The present invention relates to a photosensitive material processing apparatus, and more particularly relates to an automatic developing apparatus for developing silver halide photosensitive material. Specifically, the present invention relates to an improvement in a solid processing agent replenishing mechanism provided in an automatic developing apparatus. In other words, the present invention relates to a compact automatic developing apparatus in which dissolution work to dissolve processing agent is avoided so that the workability can be greatly improved and excellent moisture-proof effect can be provided to prevent the decomposition of solid processing agent and further excellent photographic characteristics can be stably provided.

After silver halide material has been exposed to light, it is subjected to the processing of development, desilvering, washing and stabilization. Usually, this processing is conducted by an automatic developing apparatus. In this case, a replenishment type developing apparatus is generally employed, in which a replenisher is fed into the automatic developing apparatus. Due to the foregoing replenishment type developing apparatus, the degree of activity of the processing agent in a processing tank can be controlled to be constant.

In the replenishment type developing apparatus, substance that has dissolved out from photosensitive material can be diluted, and components that have evaporated and consumed can be replenished. As a result of replenishment, a large amount of solution overflows and discharges out of the developing apparatus.

In order to process photosensitive materials on a commercial base, it is necessary to reduce the cost and labor. Also, it is necessary to prevent the public pollution. Further, in order to enhance the commodity value, it is necessary to use a processing solution, the amount of which is as small as possible, and it is also necessary that the processing performance is stable and excellent.

In order to meet the demand described above, a method is disclosed in Japanese Patent Publication Open to Public Inspection No. 119454/1993, by which almost all processing agent components are solidified and directly charged into a processing tank.

However, this method is disadvantageous in that a moisture proof measure can not be appropriately taken. Further, powder generated from the solidified processing agent is scattered and mixed in another processing tank, so that the photographic performance is deteriorated. Consequently, it is urgent to develop technology for solving the above problems.

In a solid processing agent replenishing apparatus for processing photosensitive material, a plurality of tablet type solid processing agents are accommodated in an accommodating container, and the accommodating container is attached to the solid processing agent replenishing apparatus, and an appropriate amount of solid processing agent is charged from the accommodating container into a processing solution tank. In this type solid processing agent replenishing apparatus for processing photosensitive material, when the accommodating container containing the solid processing agent is detached from the replenishing apparatus, at least one tablet or a small amount of solid processing agent is left in a solid processing agent receiving portion of the replenishing apparatus, and it is difficult to remove the tablet of solid processing agent from the receiving portion. Usually, the solid processing agent replenishing apparatus is arranged above the replenishing tank. Therefore, the solid processing agent replenishing apparatus is exposed to a moist atmosphere. Accordingly, when the photosensitive material processing apparatus is not used over a long period of time, the aforementioned residual solid processing agent absorbs moisture and deteriorates, which causes a failure of drive of the replenishing apparatus and further the solid processing agent is not appropriately charged into the processing tank. When this deteriorated solid processing agent is charged into the processing tank, the photographic characteristics are deteriorated.

Solid processing agent charging apparatus are disclosed in Japanese Patent Publication Open to Public Inspection Nos. 119454/1993 and 213454/1992 and Japanese Utility Model Open to Public Inspection No. 179729/1989. However, in these solid processing agent charging apparatus, the solid processing agent remains in the solid processing agent charging section when the operation of the charging apparatus is stopped. In the aforementioned unexamined patents, there is no description of suggesting the object of the present invention.

In the case where the solid processing agent remains in the supply section of the solid processing agent supply device, various problems may be encountered as described above. The present inventors made various investigations into these problems and found the following: In the case where the solid processing agent is not left in the solid processing agent supply section but left in the solid processing agent accommodating container, the solid processing agent functions as a drying agent, so that the overall accommodating container can be maintained in a dry condition. Therefore, the various problems described above can be solved. Even when the solid processing agent is stored in a more severe condition, only the solid processing agent located at a position close to the outlet of the accommodating container absorbs the moisture or is denatured a little, and the solid processing agent in the accommodating container is not changed at all. The present invention has been achieved in this way.

Further, the denatured solid processing agent located at the outlet of the accommodating container is used up at the first charging operation after the stoppage of the apparatus. Therefore, the solid processing agent in the accommodating container does not further absorb the moisture, so that the solid processing agent is not denatured any more. Accordingly, no problems are caused.

In the case of a compressed solid processing agent of high density, that is, in the case of a tablet type solid processing agent, the effect of the present invention can be remarkably provided. In other words, it is preferable to use the tablet type solid processing agent.

SUMMARY OF THE INVENTION

The present invention has been achieved to overcome the disadvantages of the prior art described above. It is an object of the present invention to provide a compact solid processing agent replenishing apparatus for processing photosensitive material having stable photographic performance, the workability of which is high, and in the photosensitive material processing agent replenishing apparatus, moisture proof measures for protecting the solid processing agent from moisture is employed so that the solid processing agent is not decomposed.

The above object can be accomplished by the present invention described below.

A solid processing agent replenishing apparatus for dropping a proper amount of a solid processing agent stored in an accommodation container so as to replenish the agent to a processing tank of a silver halid photosensitive material processing apparatus, wherein the replenishing apparatus is provided on the processing apparatus or in the vicinity of the processing apparatus, the replenishing apparatus comprises at least an accommodation container which includes a container body storing a plurality of tablet type solid processing agents and having an opening section through which the processing agents are discharged and a sheltering cover member to open or close the opening section of the container body, and a solid processing agent supply device which includes an attaching section to detachably hold the accommodation container vertically or slantingly, an inlet opening section being connected with the opening section of the container body so that the solid processing agent is received from the container body, and an outlet opening section to discharge the received solid processing agent, wherein on a stop condition before the solid processing agent is received to the solid processing agent supply device, the solid processing agent is stopped on a position of a wall in the vicinity of the inlet opening of the solid processing agent supply device so that the receiving of the processing agent from the accommodation container is blocked, on the other hand, in the time of replenishing to the processing tank, the solid processing agent is received from the accommodation container to the solid processing agent supply device by a driving means and discharged from the outlet opening.

The solid processing agent replenishing apparatus for processing photosensitive material is arranged in the photosensitive material processing apparatus. An appropriate amount of tablet type solid processing agent is dropped into a processing tank from an accommodating container for accommodating the solid processing agent. The solid processing agent replenishing apparatus comprises: a solid processing agent accommodating container including a container main body having an opening through which the solid processing agent is discharged, the container main body accommodating a plurality of tablets of solid processing agent, the solid processing agent accommodating container also including a shielding cover member capable of opening and closing the container main body; an attaching section for detachably holding the solid processing agent accommodating container so that the solid processing agent accommodating container can be held diagonally or vertically; a solid processing agent replenishing main body including an inlet opening for receiving the solid processing agent from the container main body, the inlet opening being connected with the opening of the container main body, the solid processing agent replenishing main body also including an outlet opening for discharging the received solid processing agent; a rotary conveyance member rotatably mounted on a shaft in the solid processing agent replenishing main body, the rotary conveyance member including a recess for receiving the solid processing agent discharged from the container main body; and a drive means for driving the rotary conveyance member, wherein a wall portion of the rotary conveyance member peripheral to the entrance of the recess of the rotary conveyance member stops at a position where the solid processing agent can not be received from the solid processing accommodating container when the rotary conveyance member is in a stopping condition in which the solid processing agent is not received, and the recess receives the solid processing agent from the accommodating container when the rotary conveyance member is rotated by the drive means so that the solid processing agent can be discharged from the outlet opening.

The solid processing agent described in the present invention is a powder type, a granule type, a pill type or a tablet type, preferably is a tablet type solid processing agent in which powder or granules are formed into a predetermined shape by means of compression. It is more preferable that the solid processing agent is formed into a tablet, the section of which is circular.

DETAILED DESCRIPTION OF THE PREFERRED EMBODIMENT

Figure 1:
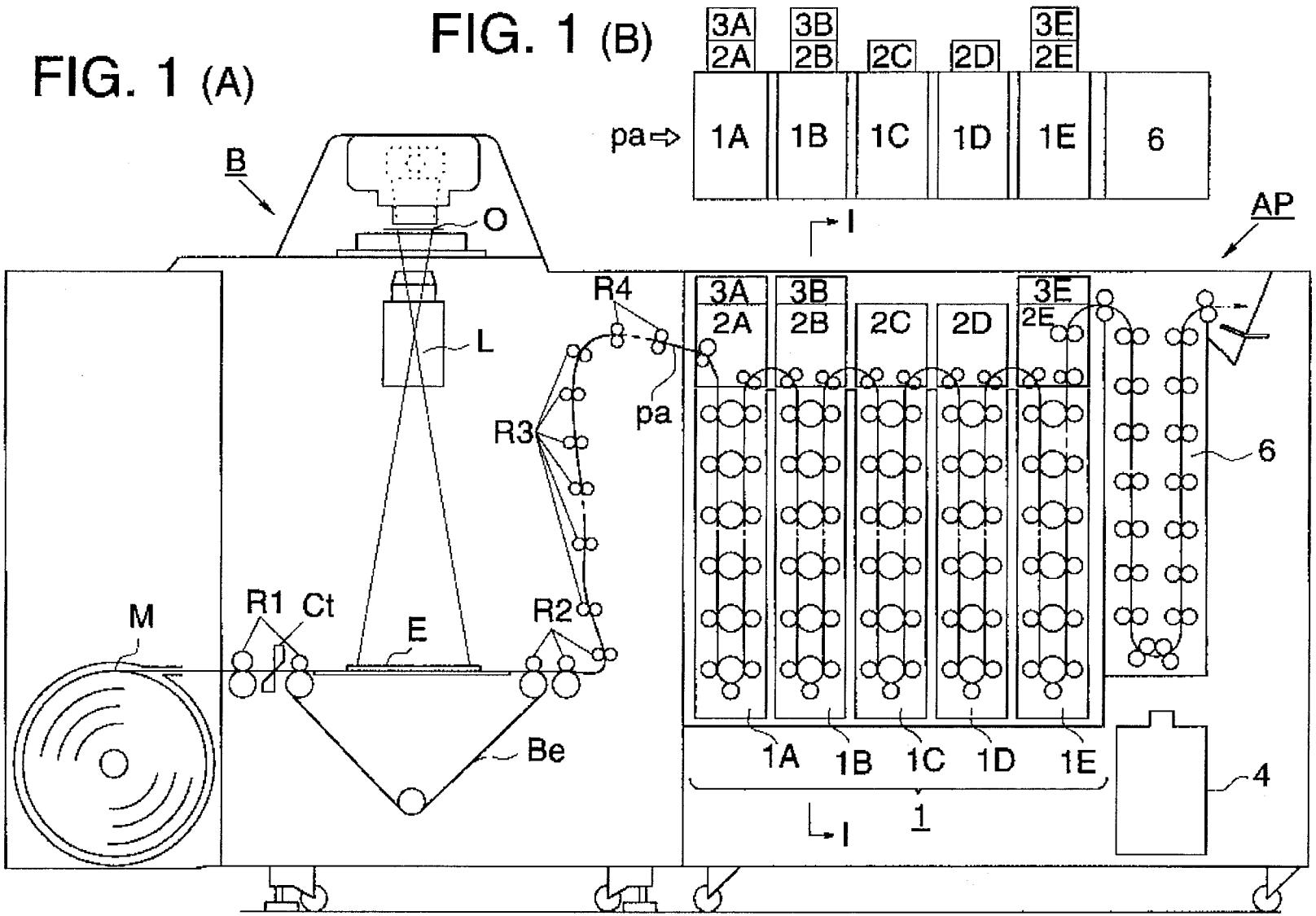
FIGS. 1(A) and 1(B) show front and plan arrangement views of the silver halide photosensitive material processing apparatus.

Next, with reference to the accompanying drawings, an example of the solid processing agent replenishing apparatus of the present invention for processing photosensitive material will be described as follows.

An automatic developing apparatus to which the present invention can be applied will be explained with reference to the accompanying drawings. FIG. 1(A) is a front arrangement view showing the construction of a silver halide photosensitive material processing apparatus (printer processor) in which the automatic developing apparatus A and photographic printer B are integrated into one body, and FIG. 1(B) is an arrangement plan view of the automatic developing apparatus A.

In FIGS. 1(A) and 1(B), in the left lower portion of the photographic printer B, there is provided a magazine M in which a roll of photographic paper "pa", which is an unexposed silver halide photographic material, is accommodated. The photographic paper "pa" is pulled out from the magazine M and conveyed by the feed rollers R1 and cut into a predetermined size by the cutter Ct. In this way, a sheet of photographic paper "pa" can be provided. This sheet of photographic paper "pa" is conveyed by the belt conveyance means Be. Then an image of the original O is exposed onto the sheet of photographic paper "pa" by a light source and lens L in the exposure section E. The exposed sheet of photographic paper "pa" is further conveyed by a plurality of pairs of feed rollers R2, R3 and R4, so that the sheet of photographic paper "pa" is introduced into the automatic developing apparatus A. In the automatic developing apparatus A, the sheet of photographic paper "pa" is successively conveyed by a roller conveyance means (the reference numeral is not attached to the means) into the color development tank 1A, bleaching and fixing tank 1B and stabilizing tanks 1C, 1D, 1E, wherein these tanks substantially compose a processing tank 1. Due to the foregoing, the sheet of exposed photographic paper "pa" is subjected to color development, bleaching and fixing processing and stabilizing processing. After the processing has been completed, the sheet of photographic paper "pa" is dried by the drying section 6, and then discharged outside of the apparatus.

In this connection, the one-dotted chain line in the drawing shows a conveyance passage of the silver halide photosensitive material. In this example, the photosensitive material is cut into a sheet and introduced into the automatic developing apparatus A, however, a strip-shaped photosensitive material may be introduced into the automatic developing apparatus A. In this case, the processing efficiency can be enhanced when an accumulator for temporarily stocking the photosensitive material is provided between the automatic developing apparatus A and photographic printer B. Of course, the automatic developing apparatus A of the present invention may be constructed integrally with the photographic printer B, or alternatively the automatic developing apparatus A of the present invention may be constructed separately from the photographic printer B. Of course, the silver halide photosensitive material processed by the automatic developing apparatus A of the present invention is not limited to the exposed photographic paper, but an exposed negative film may be applied to the automatic developing apparatus A of the present invention. The explanation of the present invention is made under the condition that the automatic developing apparatus A includes the color development tank 1A, bleaching and fixing tank 1B and stabilizing tanks 1C, 1D, 1E, wherein these tanks substantially compose a processing tank 1. However, it should be noted that the present invention is not limited to the specific example. The present invention can be applied to an automatic developing apparatus having four tanks of a color developing tank, bleaching tank, fixing tank and stabilizing tank. The color development tank 1A, bleaching and fixing tank 1B and stabilizing tanks 1E are respectively provided with dissolution tanks 2A, 2B, 2E (referred to as a dissolution tank 2 hereinafter) and the solid processing agent supply devices 3A, 3B and 3E for supplying the solid processing agent. Numerals 2C and 2D are circulation tanks communicated with the stabilizing tanks 1C, 1D. Numeral 4 is a water tank for replenishing water to the color developing tank 1A and the stabilizing tank 1E.

Figure 2:
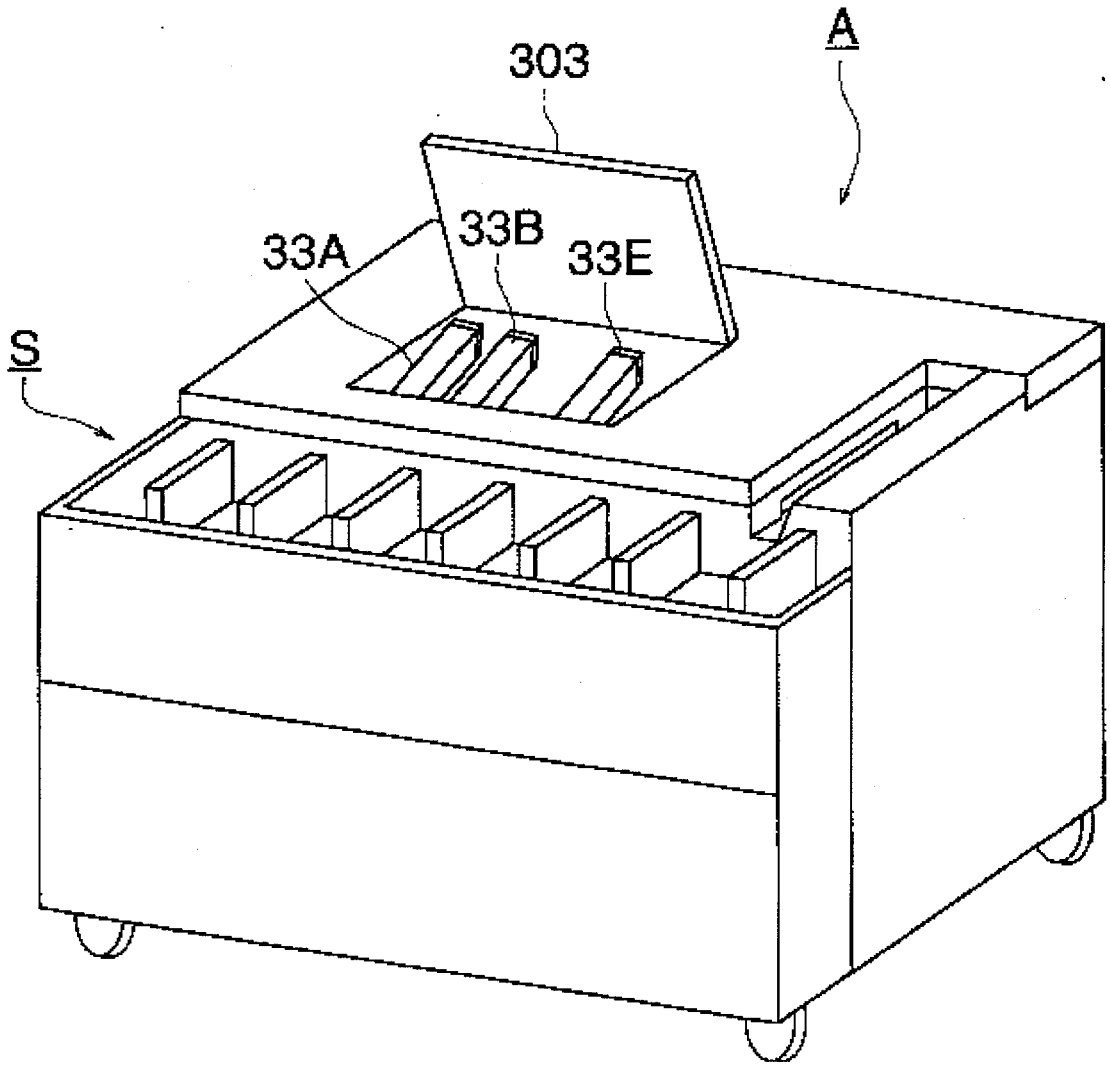
FIG. 2 is a perspective view of the automatic developing apparatus relating to the present invention.

FIG. 2 is a perspective view showing the entire automatic developing apparatus A in which the automatic developing apparatus A of the present invention and sorter S are integrally combined. In FIG. 2, the cover 303 of the automatic developing apparatus A is opened upward, and the accommodating containers 33A, 33B, 33E having solid processing agent are respectively inserted into the attaching section not shown in the drawing. After that, they are fixed.

Figure 3:
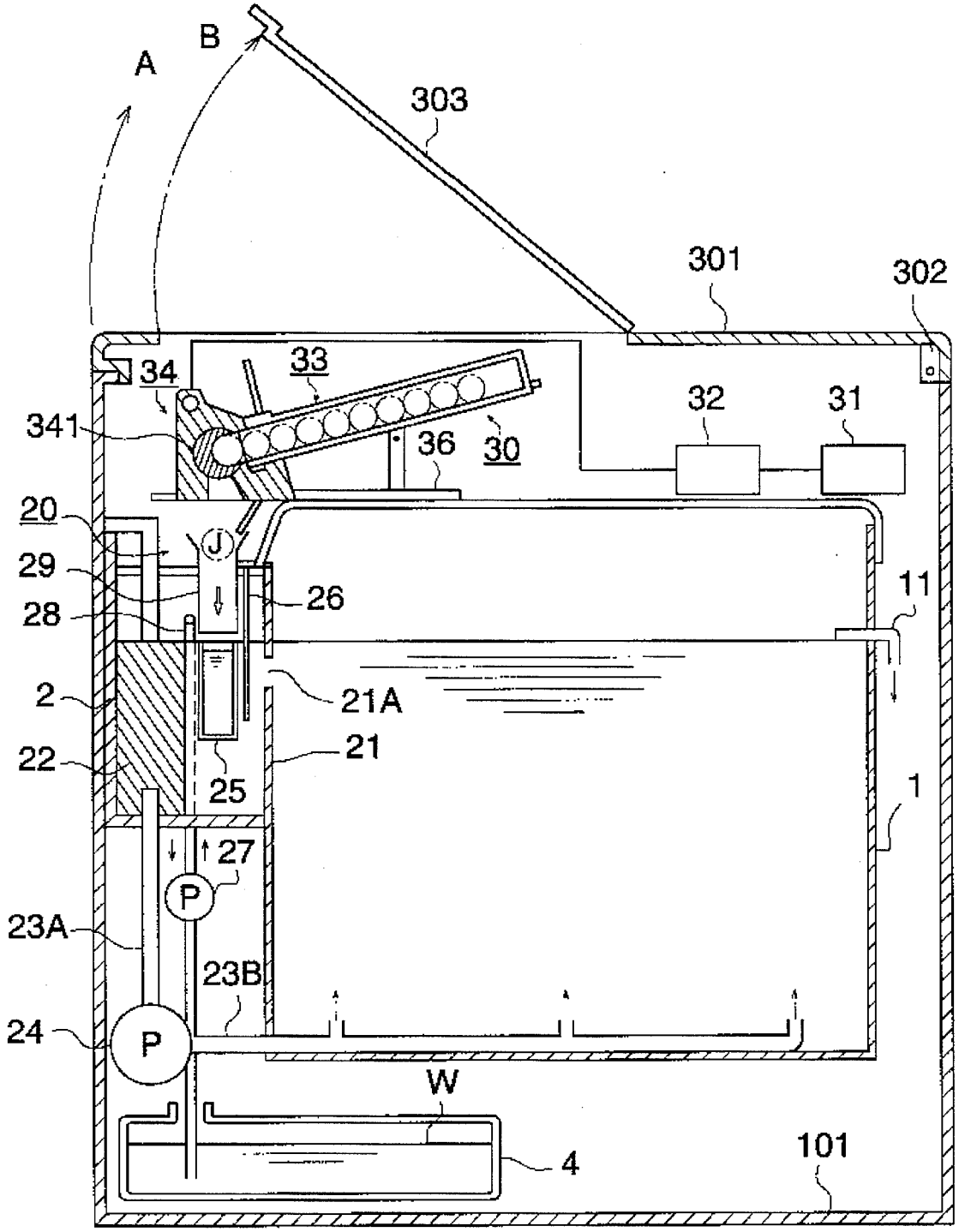
FIG. 3 is a sectional view of the automatic developing apparatus.

FIG. 3 is a sectional view of the processing agent charging section and processing agent supply means of the color development tank A taken on line I—I in FIG. 1. In this case, the construction of the bleaching and fixing tank 1B and that of the stabilizing tank 1E are the same as the construction of the color development tank 1A. Therefore, the explanation of the processing tank 1 can be applied to all tanks of the color development tank 1A, bleaching and fixing tank 1B, and stabilizing tank 1E. In this connection, for enhancing the understanding of the invention, the conveyance means for conveying the photosensitive material is omitted in the drawing. In this example, explanations will be made under the condition that tablets of solid processing agent are used.

The processing tank 1 for processing the photosensitive material includes a solid processing agent charging section 20 for supplying tablets of solid processing agent, the solid processing agent charging section 20 being integrally provided outside the separation wall of the processing tank 1, and a constant temperature tank 2. The processing tank 1 and constant temperature tank 2 are separated by a partition wall 21 on which a communicating hole 21A is formed so that the processing solution can be communicated through the communicating hole 21A. Since an enclosure 25 for receiving the tablets J of solid processing agent is provided in the solid processing agent charging section 20 disposed at an upper position of the dissolution tank 2, the tablets J of solid processing agent are not moved to the processing tank 1 in the form of a solid body. In this connection, the enclosure 25 is made of material such as a net or filter so that the processing solution can pass through the enclosure 25, however, the tablet J in the form of a solid body can not pass through the enclosure 25 until it is dissolved in the solution.

A cylindrical filter 22 is disposed below the dissolution tank 2 in such a manner that the cylindrical filter 22 can be replaced. The cylindrical filter 22 removes paper scraps and others in the processing solution. A circulation pipe 23A connected with the suction side of a circulation pump 24 (circulation means) is inserted into the filter 22 passing through the lower wall of the constant temperature tank 2.

The circulation system includes the circulation pipes 23A, 23B forming a circulation passage of the processing solution, and also includes the circulation pump 24. One end of the circulation pipe 23B is communicated with the delivery side of the circulation pump 24, and the other end penetrates a lower wall of the processing tank 1, so that the circulation pipe 23 is communicated with the processing tank 1. Due to the foregoing construction, when the circulation pump 24 is operated, the processing solution is sucked from the constant temperature tank 2 and discharged into the processing tank 1, so that the discharged processing solution is mixed with the processing solution in the processing tank 1, and then sent to the dissolution tank 2. In this way, the processing solution is circulated. It is preferable that the flow rate of this circulating processing solution is not less than 0.1 with respect to the tank capacity. In this case, the flow rate is defined as a ratio of (an amount of circulating solution in one minute)/(the tank capacity). More preferably, the flow rate is 0.5 to 2.0. The circulating direction of the processing agent is not limited to the direction shown in FIG. 3, but the direction may be reverse to that shown in FIG. 3.

A waste solution pipe 11 is provided for permitting the processing solution in the processing tank 1 to overflow, so the solution level can be maintained constant and an increase in the components conveyed from other tanks into the processing tank 1 can be prevented. Further, an increase in the components oozing out from the photosensitive material can be prevented.

A rod-shaped heater 26 penetrates an upper wall of the dissolution tank 2, and is dipped in the processing solution in the dissolution tank 2. The processing solution in the dissolution tank 2 and processing tank 1 is heated by this heater 26. In other words, the heater 26 is a temperature regulating means for regulating the temperature of the processing solution in the processing tank 1, so that the temperature can be controlled to be maintained in an appropriate range, for example, in a range from 20° to 55° C. Numeral 28 is a water replenishing device. The water replenishing device 28 supplies replenishment water W sent from the water tank 4 by the pump 27. Numeral 29 is a guide member for receiving the solid processing agent J dropped from the solid processing agent replenishing device 30, and the guide member 29 guides the received solid processing agent J to the solid processing agent charging section 20.

A throughput information detecting means 31 is disposed at an entrance of the automatic developing apparatus A, and detects the throughput of the photosensitive material to be processed. This throughput information detecting means 31 is comprised of a plurality of detecting members that are disposed in a transverse direction. This throughput information detecting means 31 detects the width of photosensitive material, and the result of detection is used for counting the detection time. Since the conveyance speed of photosensitive material is previously set in a mechanical manner, the throughput of photosensitive material, that is, the area of processed photosensitive material can be calculated form the width and time information. An infrared ray sensor, microswitch and ultrasonic sensor capable of detecting the width and conveyance time of photosensitive material can be used for this throughput information detecting means 31. A means for indirectly detecting the area of processed photosensitive material may be used for this throughput information detecting means 31. For example, in the case of the printer processor shown in FIG. 1, a means for detecting an amount of printed photosensitive material may be adopted, or alternatively, a means for detecting an amount of processed photosensitive material, the area of which is predetermined, may be adopted. Concerning the detecting time, in this example, detection is carried out before processing, however, detection may be carried out after processing or while the photosensitive material is being dipped in the processing solution. In these cases, the throughput information detecting means 31 may be disposed at an appropriate position so that detection can be conducted after processing or while the photosensitive material is being processed. In the above explanation, detection is conducted on the area of processed photosensitive material, however, the present invention is not limited to the specific example. For example, any values proportional to the throughput of photosensitive material may be adopted. For example, a concentration of the processing solution in the processing tank or a change in the concentration may be used. It is not necessary to provide the throughput information detecting means 31 for each processing tank 1A, 1B, 1C, 1D, 1E, and it is preferable that one throughput information detecting means 31 is provided for one automatic developing apparatus A. Reference numeral 32 is a throughput supply control means for controlling the supply of processing solution in accordance with a signal sent from the throughput information detecting means 31.

The solid processing agent replenishing device 30 used for the photosensitive material processing apparatus of the present invention is disposed above the photosensitive material processing apparatus, and comprises accommodating containers 33A, 33B, 33E (referred to as the accommodating containers 33 hereinafter), solid processing agent supply means 34 and drive means, wherein the solid processing agent replenishing device 30 is tightly closed by an upper cover 301. The upper cover 301 is rotatably connected with a main body 101 accommodating the processing tank 1 and dissolution tank 2, through a support shaft 302 attached to the back of the main body. The upper cover 301 is lifted upward as shown by a one-dotted chain line in FIG. 3, so that the front and upper portions of the apparatus can be widely opened. In this way, inspection of the solid processing agent replenishing device 30, and replacement of the filter 22 can be easily conducted.

A cover 303 is rotatably connected with a portion of the upper surface of the upper cover 301. When the cover 303 is opened as illustrated by a one-dotted chain line B in the drawing, the accommodating container 33 is attached or replaced.

FIGS. 4(A)–4(E) show various configurations of the tablet type solid processing agent J. FIG. 4(A) is a sectional view of the cylindrical flat tablet type solid processing agent J, wherein the configuration is circular and the corners are chamfered by the radius of curvature of r. FIG. 4(E) is a perspective view of the tablet type solid processing agent J. FIG. 4(B) is a sectional view of the flat tablet type solid processing agent J, wherein the configuration is circular, and the upper and lower surfaces are flat, and the circumferential surface is formed convex by the radius of curvature of R. FIG. 4(C) is a sectional view of the tablet type solid processing agent J, wherein the configuration is flat, and the upper and lower surfaces are formed spherical. FIG. 4(D) is a sectional view of the tablet type solid processing agent J, wherein the configuration is a doughnut-shape having a hole at the center.

Figure 5:
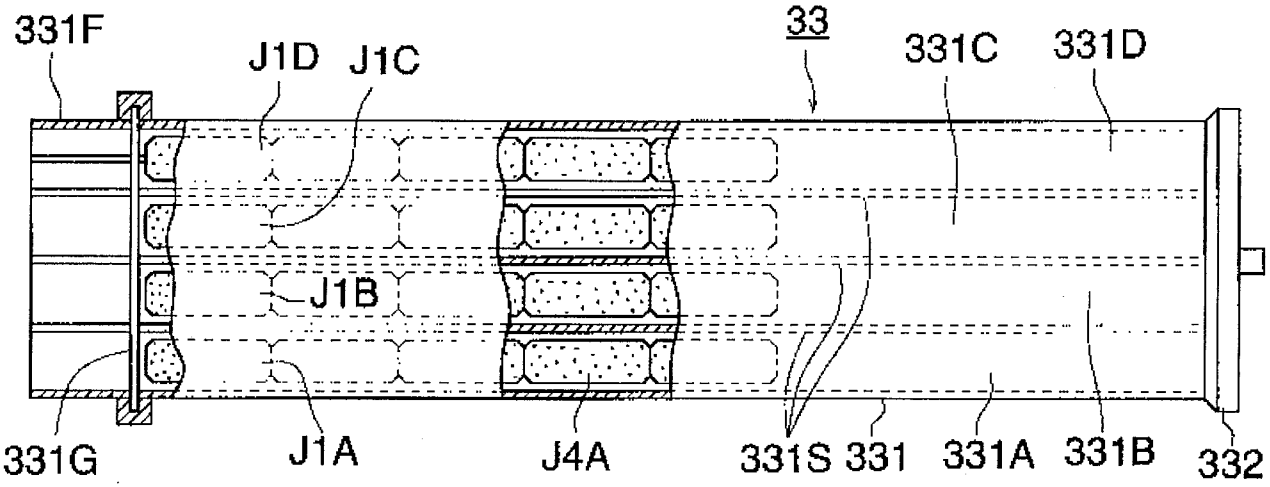
FIGS. 5(A) and 5(B) show plan and side views of the accommodating container for accommodating the solid processing agent.
Figure 5:
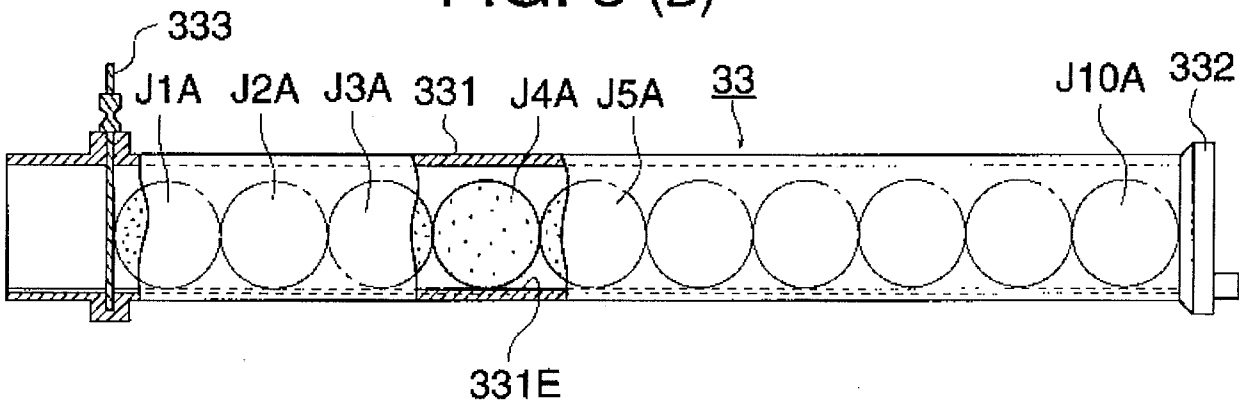
Figure 6:
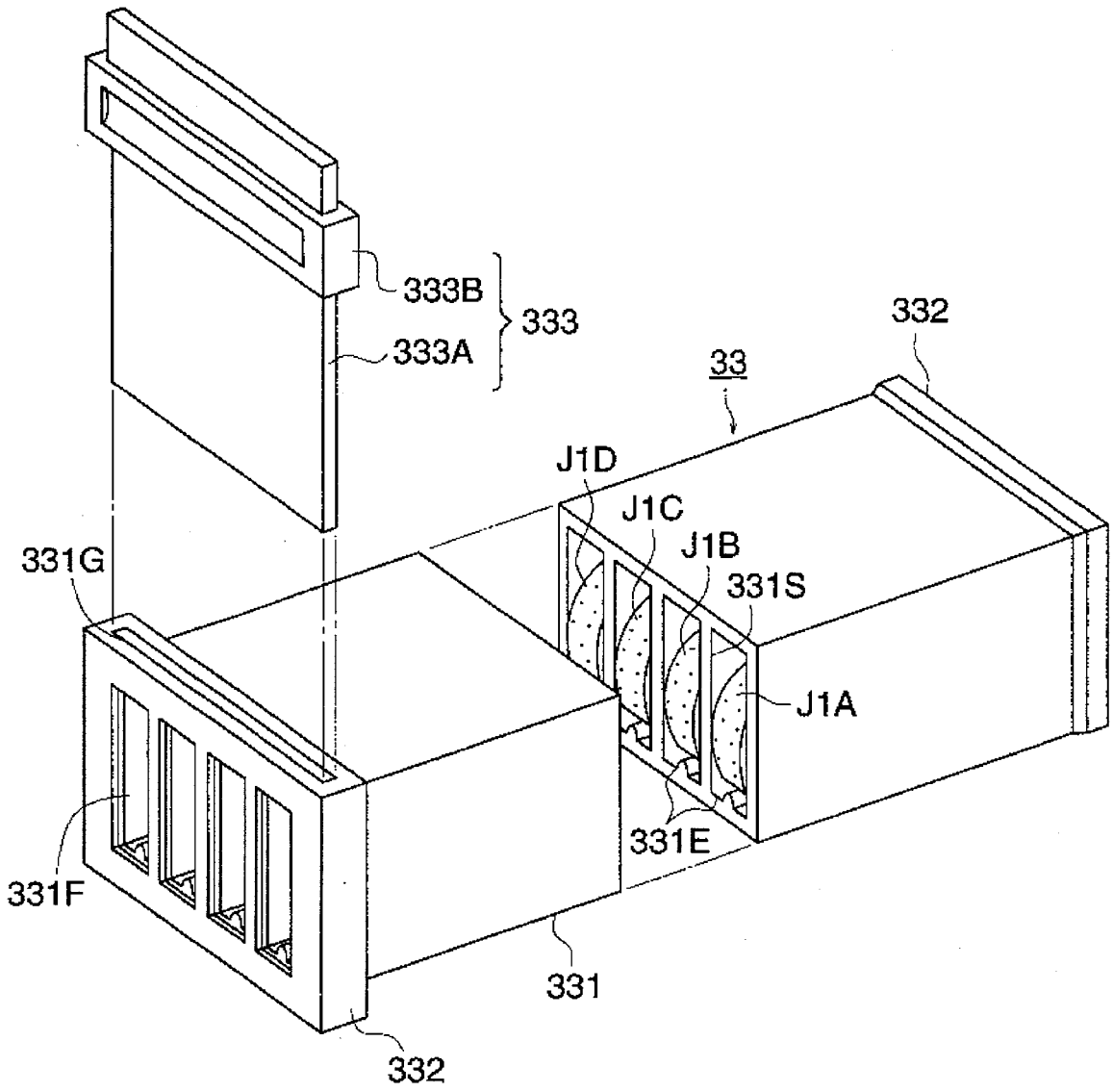
FIG. 6 is a perspective view of the accommodating container.

FIGS. 5(A) and 5(B) are views showing the accommodating container (cartridge) 33 for accommodating the tablet type solid processing agent J. FIG. 5(A) is a plan view including a partially cutaway view. FIG. 5(B) is a side view of the accommodating container 33. FIG. 6 is a perspective view of the accommodating container 33.

The accommodating container 33 includes: a container main body 331, the configuration of which is like a hollow square hole; a cap member 332 for closing the rear opening of the container main body 331; and a shielding cover member (sliding cover) 333 capable of opening and closing the opening 331F being slid in a groove 331G provided close to the opening 331F in the front of the container main body 331.

Three sets of partition walls 331S are integrally fixed inside the container 331, so that the inside of the container 331 is divided into four chambers 331A, 331B, 331C, 331D. In each chamber, the approximately cylindrical tablets of solid processing agent J are longitudinally accommodated under the condition that each outer circumference is externally contacted with the inside wall of the chamber. Specifically, 10 tablets of solid processing agent J1A to J10A are accommodated in the first chamber 331A, and 10 tablets of solid processing agent J1B are accommodated in the second chamber 331B. In the same manner, the tablets J1C and J1D are respectively accommodated in the chambers.

A projection 331E is projected from the bottom surface of each chamber of the container main body 331. This projection 331E comes into a point of the outer circumferential surface of the tablet of solid processing agent J, so that the tablet can be easily moved, and powder separated from the tablet of solid processing agent J drops from the top of the projection 331E. Separated powder accumulates in a groove formed under the projection 331E. Accordingly, even when the powder is deposited in the groove, no problems are caused because the tablet of solid processing agent J moves on the projection 331E.

As illustrated in FIG. 6, the groove (slit) 331G is engaged with a sheet-shaped shielding sheet portion 333A of the sliding cover 333. A holding portion 333B is integrally formed at an upper portion of the shielding sheet portion 333A of the sliding cover 333.

Figure 7:
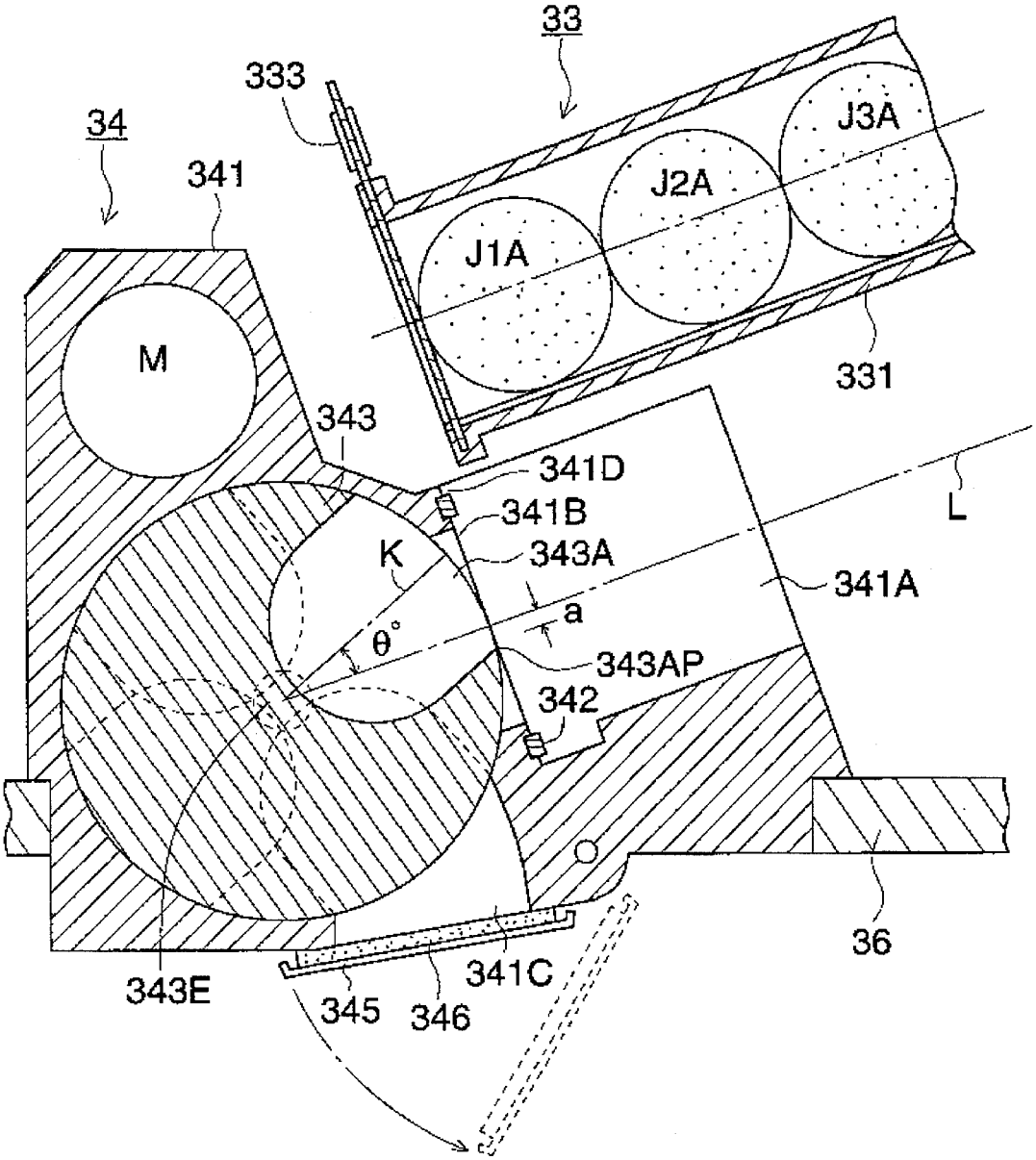
FIG. 7 is a sectional view showing the apparatus in a condition before the accommodating container is attached to the solid processing agent replenishing means.

FIG. 7 is a sectional view showing a state before the accommodating container 33 is attached to the solid processing agent supply means 34.

A fixing plate 36 for fixing the solid processing agent supply means 34 is fixed to an upper portion of the main body 101 of the automatic developing apparatus A. A supply main body 341 for diagonally supporting the accommodating container 33 is arranged at one end of the fixing plate 36 (shown in FIG. 3). The supply main body (housing) 341 is fixed to the other end of the fixing plate 36. A container attaching portion 341A to which the outer peripheral surface of the accommodating container 33 close to the opening 331F is attached to be positioned, is provided close to the entrance opening portion 341B of the supply main body 341. The accommodating container 33 is attached to the solid processing agent supply means 34 in the following manner: The accommodating container 33 is held, and the opening portion 331F is set at a diagonally lower position and attached to the container attaching portion 343A. Then the opening portion 331F of the accommodating container 33 is contacted with and pressed against a resilient moisture-proof packing 342 provided in a groove on the colliding surface 341D of the supply main body 341. At this stopping position, the accommodating container 33 is positioned and fixed by a clamp not shown in the drawing. It is preferable that the positioning angle of the accommodating container 33 is not less 10° which is the minimum angle necessary for the solid processing agent J in the accommodating container 33 to positively slide down by the action of gravity.

In the supply main body 341, there are provided an entrance opening portion 341B for receiving the solid processing agent J and a delivery opening portion 341C for discharging the solid processing agent J. In the cylindrical inner wall portion of the supply main body 341, a rotary conveyance member (rotor) 343 capable of rotating when it is driven is arranged and its shaft 343E is supported by a bearing.

Figure 8:
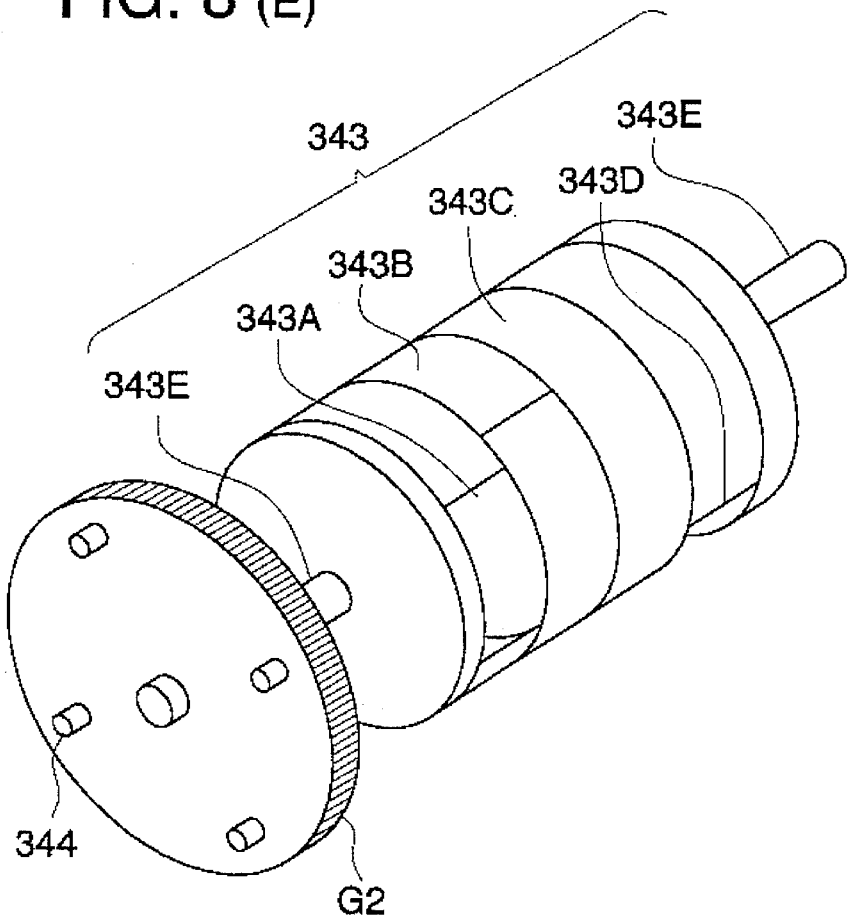
FIGS. 8(A)–8(E) show perspective and sectional views of the rotary conveyance member.
Figure 8:
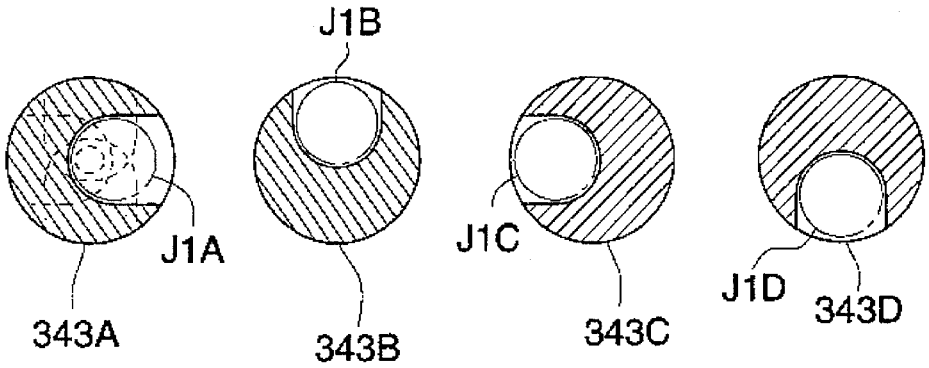

FIG. 8(E) is a perspective view of the rotary conveyance member (rotor) 343 arranged in the solid processing agent supply means 34. FIGS. 8(A), 8(B), 8(C) and 8(D) are sectional views showing the stages of the rotor 343. The rotor 343 is composed in such a manner that the rotors of 4 stages are integrally mounted on the shaft 343. The rotors are respectively provided with U-shaped recessed receiving portions 343A, 343B, 343C, 343D, and one piece of solid processing agent (J1A, J1B, J1C, J1D) is accommodated in the receiving portion of each rotor. The angular phase of each of the receiving portions 343A, 343B, 343C, 343D is shifted by 90°. Accordingly, when the rotor 343 is rotated by one revolution, the solid processing agent J1A is charged from the opening 331F of the accommodating container 33 into the first receiving portion 343A, and then the solid processing agents are successively charged into the second, third and fourth receiving portions 343B, 343C, 343D. In the same manner, the solid processing agents are successively discharged outside.

As illustrated in FIG. 7, when the rotor 343 is stopped, the center line K of the recessed portion of the receiving portion 343A opposed to the entrance opening 341B of the supply main body (housing) 341 is inclined by an angle θ with respect to the center line L of the accommodating container 33 that has been attached to the supply main body 341. Accordingly, the fore end 343AP of the entrance of the U-shaped recessed portion of the receiving portion 343A closes a portion of the entrance opening 341B. Therefore, it is impossible to supply the solid processing agent J1A from the attached accommodating container 33 to the receiving portion 343A.

The delivery opening 341C located at a lower position of the supply main body 341 is opened and closed by a shutter member 345 having a resilient pad 346 when the shutter member is oscillated.

Figure 9:
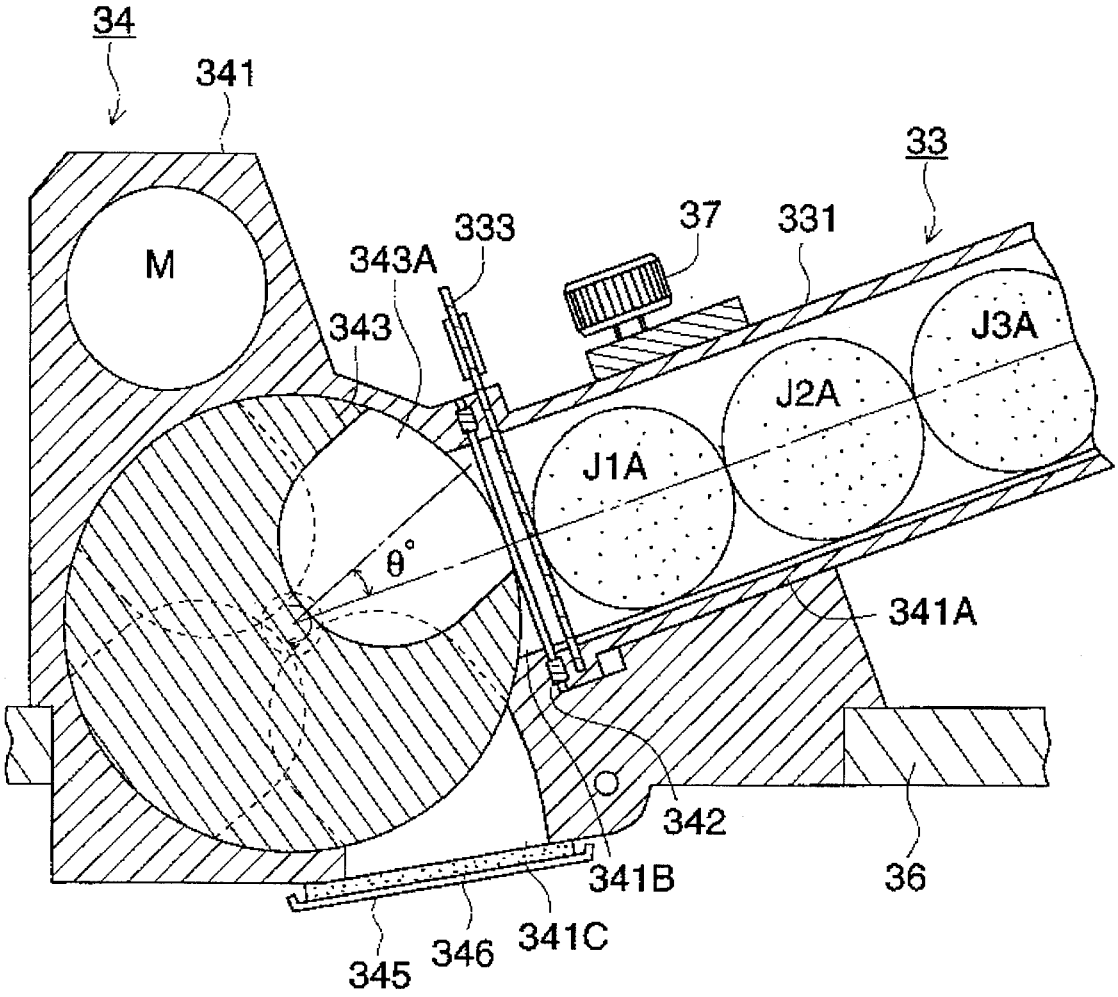
FIG. 9 is a sectional view of the solid processing agent replenishing means to which the accommodating container is attached.

FIG. 9 is a sectional view showing a state in which the accommodating container 33 is attached to the solid processing agent supply means 34. As shown in the drawing, the accommodating container 33 is fixed to a predetermined position of the container attaching portion 341A of the supply means 34. The accommodating container 33 is pressed against the entrance opening portion 341B through the resilient packing 343 by a pressing means (not shown). Then the accommodating container 33 is fixed by the clamp means 37. Under the above condition, the shielding cover member 333 closes the opening, and the solid processing agents J in the inclined accommodating container 33 are slid to the side of the shielding cover member 333. Therefore, the lead solid processing agent J1A is contacted with the inside of the shielding cover member 333 with a low pushing force.

Figure 10:
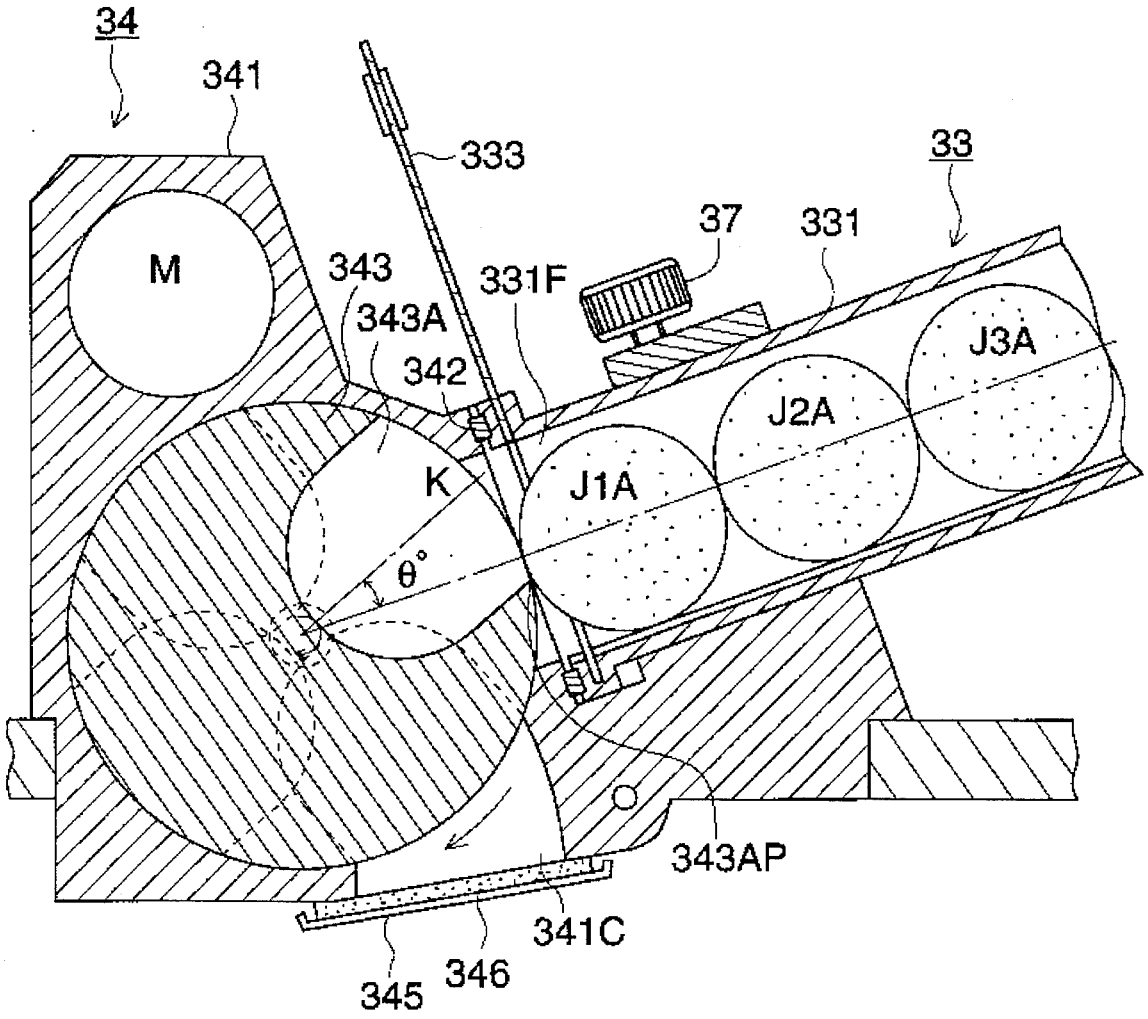
FIG. 10 is a sectional view of the solid processing agent replenishing means showing the initial condition before the rotor is rotated, wherein the shielding cover member of the accommodating container is open.

FIG. 10 is a sectional view showing a condition in which the shielding cover member 333 of the accommodating container 33 is open and the rotor is in an initial condition before rotation. When the shielding cover 333 of the accommodating container 33 is pulled up and the opening 331F is open, the solid processing agent J in the container 331 slides down by the action of gravity. Therefore, the lead solid processing agent J1A comes into contact with the fore end portion 343AP of the rotor 343 located close to the entrance of the receiving portion 343A. The lead solid processing agent J1A stops at this position. Under the above condition in which the rotor is stopped, the outer circumference of the rotor 343 closely comes into contact with the inner cylindrical wall of the supply main body 341, and the accommodating container 33 is airtightly connected with the supply main body 341 through the resilient packing 342, and further the delivery opening 341C is airtightly closed by the shutter member 345 having the resilient pad 346. Therefore, the solid processing agent J provided in the accommodating container 33 that has been opened can be maintained in a moisture-proof condition.

In the drawings, θ is defined as a phase angle formed between the central axis (L) of the tablets in the container and the central axis (K) of the tablet receiving direction of the receiving portion 343A. In this example, it is preferable that the phase angle θ is determined to be 5° to 180°, it is more preferable that the phase angle θ is determined to be 10° to 90°, it is still more preferable that the phase angle θ is determined to be 10° to 45°. In this connection, the phase angle θ is 20° in FIG. 10.

Figure 11:
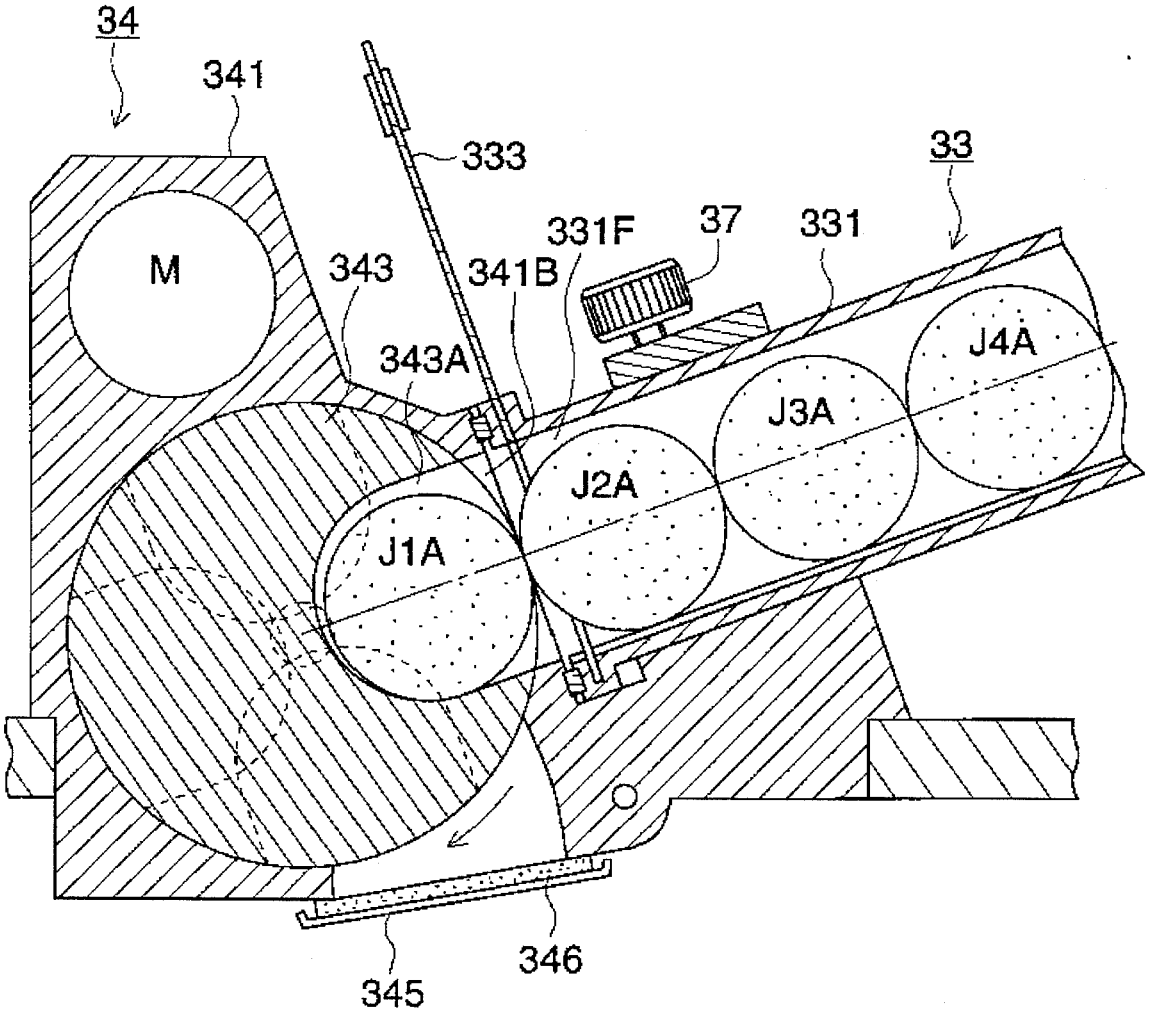
FIG. 11 is a sectional view of the solid processing agent replenishing means showing a condition immediately after the start of rotation of the rotor.

FIG. 11 is a sectional view showing a condition in which the rotation of the rotor 343 has been started. When the rotor 343 rotated in the arrowed direction by a drive means described later and the entrance portion of the receiving portion 343A substantially coincides with the entrance opening portion 341B of the supply main body 341, the lead solid processing agent J1A diagonally slides down through the opening portion 331F of the accommodating container 33. Then the solid processing agent J1A passes through the entrance opening 341B and advances to the receiving portion 343A so that the solid processing agent J1A is accommodated in the recessed portion.

Figure 12:
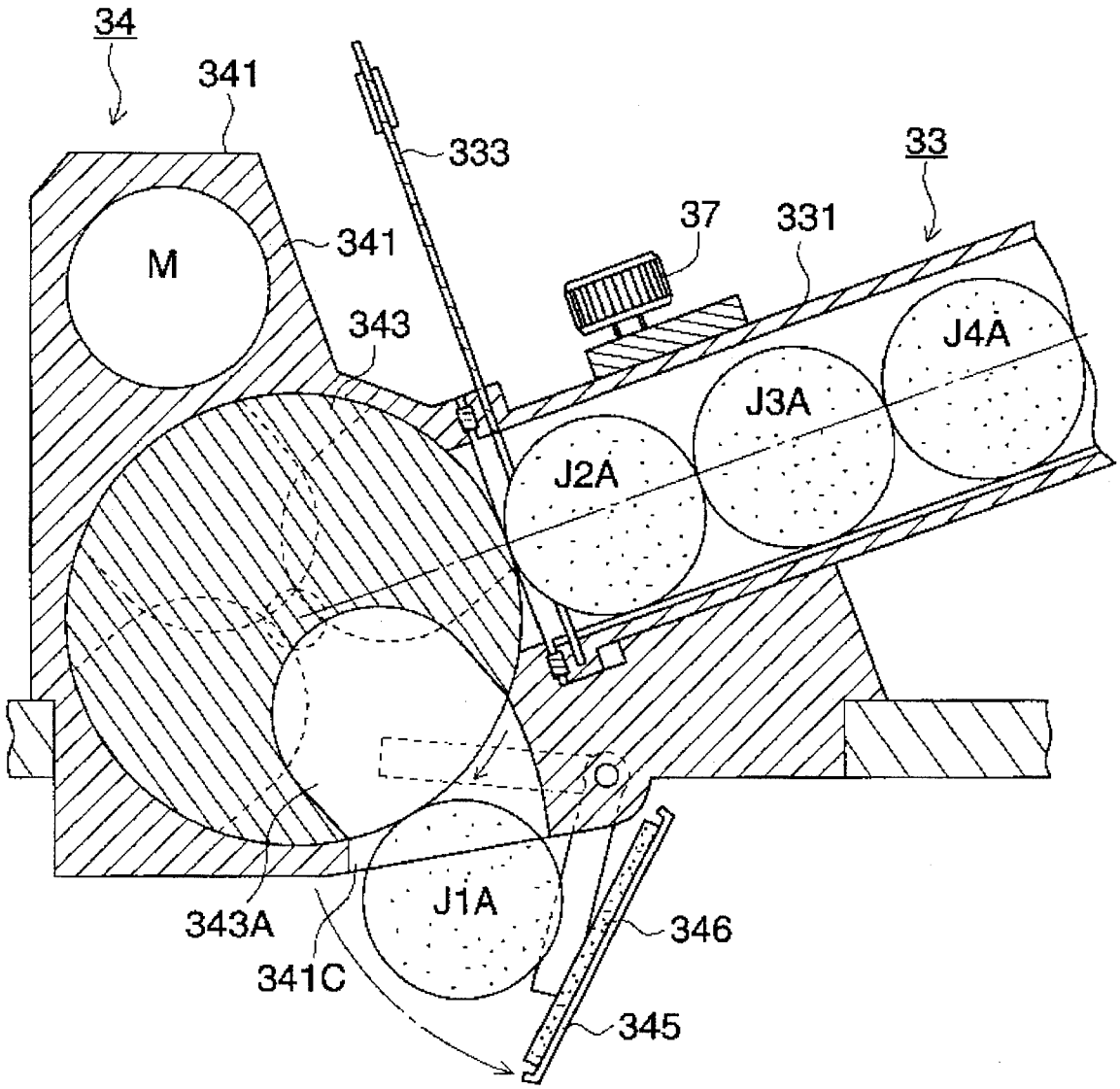
FIG. 12 is a sectional view of the solid processing agent replenishing means showing a condition in which the solid processing agent is dropped.

FIG. 12 is a sectional view of the solid processing agent supply means showing a condition in which the solid processing agent has been dropped. When the rotor 343 is further driven and the entrance of the receiving portion 343A of the rotor 343 substantially coincides with the delivery opening 341C of the supply main body 341, the solid processing agent J1A in the receiving portion 343A is dropped into the dissolution tank 2 located at a lower position. Immediately before this dropping motion, the shutter member 345 is rotated in the direction shown by a one-dotted chain line in the drawing by a drive means described later, so that the delivery opening 341C is maintained in an open condition.

When the rotor 343 is successively rotated, the solid processing agent J1B in the second row of the accommodating container 33 is accommodated in the second receiving portion 343B of the rotor 343. Then the solid processing agent J1B is conveyed by the rotation of the rotor and then dropped from the delivery opening 341C into the processing tank. In the same manner, the solid processing agent J1C in the third row and the solid processing agent J1D in the fourth row are successively dropped in order. In this way, when the rotor 343 is rotated by one revolution, the solid processing agents J1A, J1B, J1C and J1D in the first row are dropped. After that, the rotor 343 is stopped at the initial position shown in FIG. 10. In this stop condition, the solid processing agent J does not exist in the rotor 343. At the same time, the shutter member 345 is reversely rotated, so that the delivery opening 341C is closed. Therefore, the inside of the supply main body 341 and the inside of the accommodating container 33 are maintained in a moisture-proof condition. In order to prevent the solid processing agent J from being charged into the receiving portion 343A of the rotor 343 before the start of replenishment, there is provided a system in which the rotor 343 is reversed so as to stop the advancement of the solid processing agent J. However, from the viewpoint of simplifying the controlling operation, the system of the present invention is superior, in which the rotor 343 is rotated only in one direction to stop the advancement of the solid processing agent J.

When the automatic developing apparatus A and the solid processing agent replenishing device 30 are subjected to maintenance, or when they are stopped over a long period of time, the accommodating container 33 in which the solid processing agent J is accommodated is removed from the supply main body 34. In this case, the shielding cover member 333 of the accommodating container 33 is pushed downward so as to close the opening 331F. After that, the clamp means 37 is disengaged. Then as illustrated in FIG. 7, the accommodating container 33 is removed from the attaching portion 341A of the supply main body 341. Under this condition, the solid processing agent J does not exist in the rotor 343 at all, so that the rotor is in an empty condition. Accordingly, unlike the conventional method, labor is not required for picking up the residual solid processing agent J in the rotor 343. Further, damage is not caused in the supply main body 341 and the rotor 343 by the residual solid processing agent J. Furthermore, there is no possibility that a deteriorated residual tablet of solid processing agent is mistakenly dropped into the dissolution tank 2 and the image quality is lowered.

A gear G2 is fixed to one end of the shaft 343E of the rotor 343. The gear G2 is meshed with the gear G0 mounted on the drive shaft of the motor M through an intermediate gear G1. The motor M is embedded and fixed in a cavity portion formed in the supply main body 341. Four fixing pins 344 are implanted in the gear G2 at regular intervals of 90°.

On the other hand, support shafts 347 are implanted on both sides of the supply main body 341. The arm 348 and the shutter member 345 are fixed to these support shafts 347. The arm 348 is energized by the tension spring 349, so that the shutter member 345 closes the delivery opening 341C of the supply main body 341. A resilient packing member 346 is adhered onto the shutter member 345. Therefore, when the shutter 345 closes, it is pressed against the resilient packing member 346, so that the outlet opening 341C airtightly closed, and vapor of the processing solution generated from the lower dissolution tank 2 or the processing tank 1 is shut off. In this way, the moisture-proof effect of the solid processing agent J can be enhanced in the solid processing agent supply means 34 and the accommodating container 33.

Figure 13:
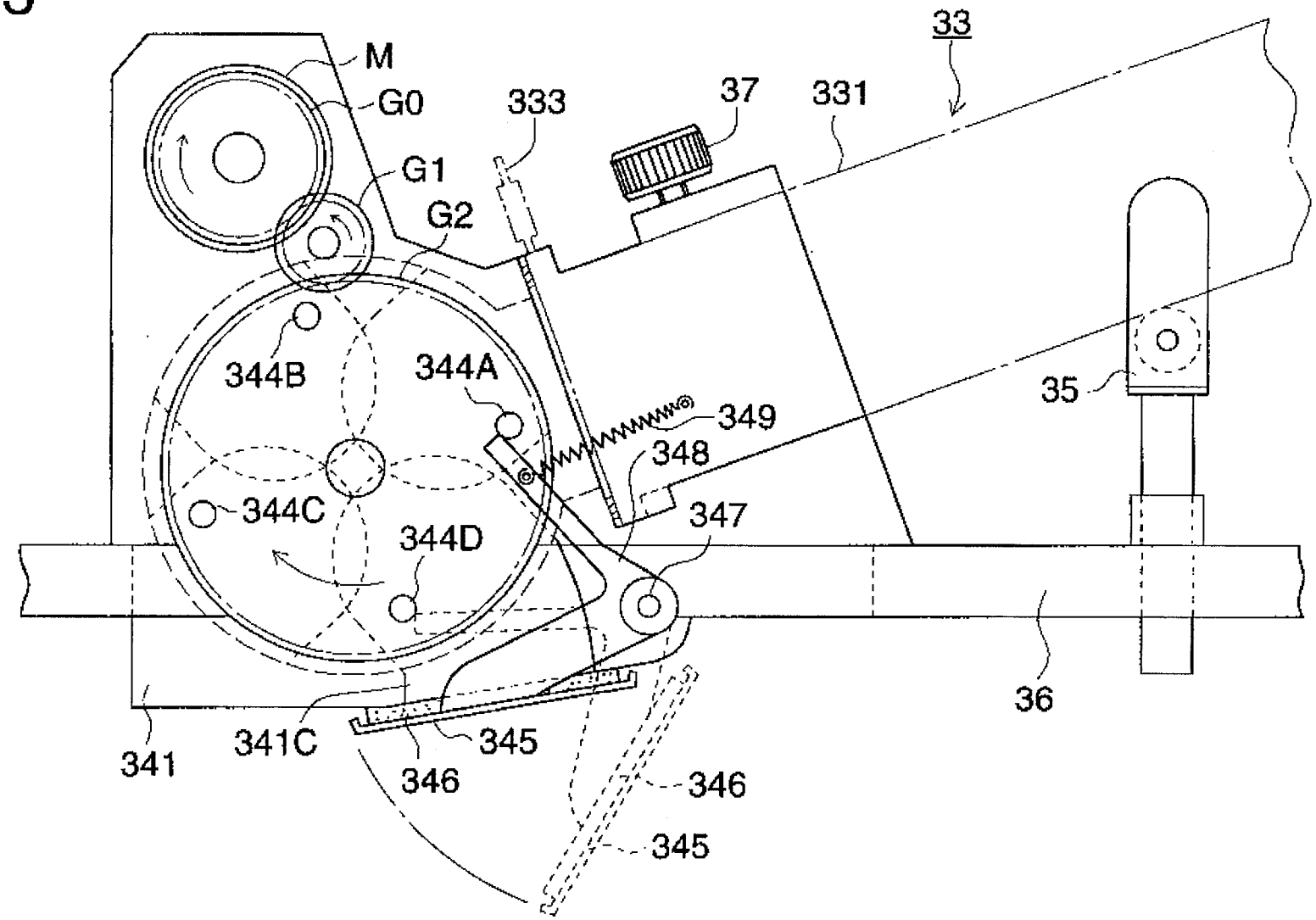
FIG. 13 is a side view of the drive means for driving the rotor and the shielding cover member.

FIG. 13 is a side view of the drive means for driving the rotor 343 and the shielding cover member 345.

When the motor M is driven, the rotor 343 is rotated through the gear train composed of gears G0, G1 and G2. When the gear G2 is rotated, the fixed pin 344A pushes an end of the arm 348. Accordingly, the arm 348 is rotated counterclockwise around the support shaft 347, so that the shutter member 345 opens the outlet opening 341C of the supply main body 341. When the gear G2 is further rotated, the fixed pin 344A is disengaged from the end of the arm 348, and the shutter member 345 is pulled by the tension spring 349 since the spring force is applied to it. Therefore, the outlet opening 341C is closed by the shutter member 345. Successively, the gear G2 is rotated, and the fixed pin 344B pushes the end of the arm 348, and the shutter member 345 is moved so that the outlet opening 341C is put into an open condition. Then the solid processing agent J1B is dropped through the opening, and then the outlet opening is closed when the engagement is released. In the same manner, the fixed pins 344C and 344D oscillate the shutter member 345, so that the outlet opening 341C can be opened and closed.

Figure 14:
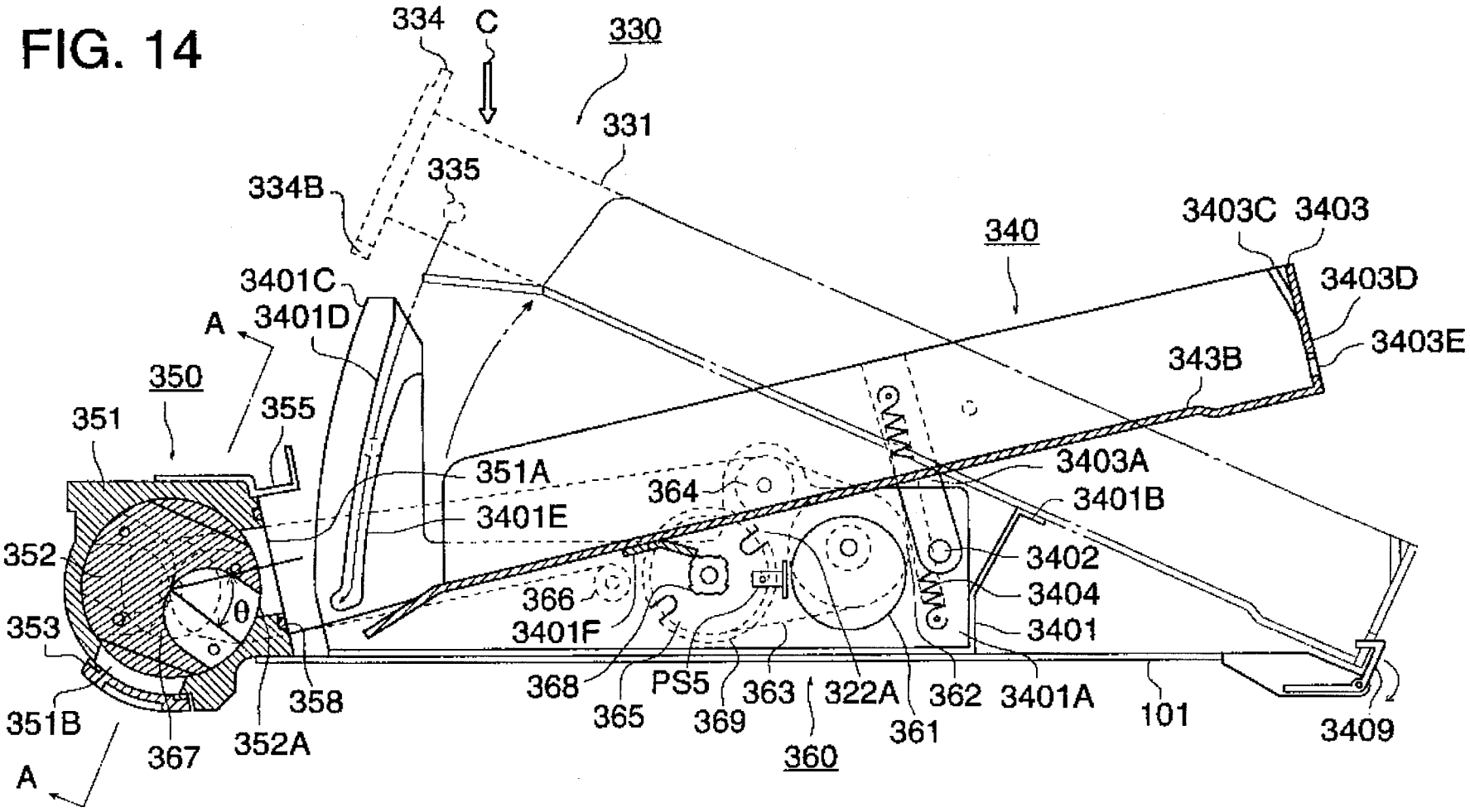
FIG. 14 is a sectional side view in which the accommodating container attaching means, replenishing means and drive means are shown.

FIG. 14 is a sectional side view showing another example of the solid processing agent replenishing apparatus of the present invention. In FIG. 14, the mode of operation of the accommodating container attaching means 340, supply means 350 and drive means 360 is shown.

A fixed frame 3401 of the accommodating container charging means 340, a housing member 351 and drive means 360 are fixed on an upper portion of the main body 101.

Support shafts 3402 are protruded from both side plates 3401A of the fixed frame 3401 at the right end shown in the drawing. The support shafts 3402 are engaged in holes disposed at a lower end of an arm 3403A fixed on both sides of a container holding member 3403 for holding the accommodating container 330, so that the container holding member 3403 can be oscillated around the support shaft 3402. The side plate 3401A and arm 3403A are respectively provided with a fixing pin, and a tension spring 3404 is attached to the fixing pin. Therefore, as illustrated by a one-dotted chain line in the drawing, the container holding member 3403 is rotated clockwise being pushed by the spring, and the bottom portion of the container holding member 3403 comes into contact with a stopper portion 3401B protruding to a right upper portion of the fixed frame 3401. Then the movement of the container holding member 3403 is stopped, and the container holding member 3403 is maintained in a condition before the accommodating container 330 is mounted, that is, the container holding member 3403 is maintained at the position before the charging.

At a position close to the left end of the side plate 3401A of the fixed frame 3401, there is provided a rising portion 3401C, in which a circular guide groove 3401D is formed, wherein the circular guide groove 3401D is provided around the support shaft 3402. The accommodating container 330 is charged to the container holding member 3403 of the accommodating container charging means 340, and the accommodating container holding member 3403 is oscillated around the support shaft 3402, so that the left end portion of the container holding member 3403 is pushed downward in the direction C shown in the drawing. Then the guide pin 335 of the accommodating container 330 advances in the guide groove 3401D while the guide pin 335 is being pushed downward by a pushing member 3403C of the accommodating container charging means 340. An L-shaped groove portion 3401E is formed in the lowermost portion of the guide groove 3401D. When the pin 335 enters this L-shaped groove 3401E being pushed by the pushing member 3403C, the front of the accommodating container 330 closely comes into contact with an entrance portion 351A of the supply means 350.

The supply means 350 is disposed in the housing member 351 in such a manner that the supply means 350 can be rotated on an inner circumferential surface of the housing member 351. The supply means 35 includes a rotatable solid processing agent conveying member (rotor) 352, and a shutter section 353 for opening and closing the outlet portion 351B, wherein the solid processing agent conveying member (rotor) 352 has a pocket portion 352A by which a predetermined amount of solid processing agent J is received from the inlet portion 351A and moved to the outlet portion 351B.

A frame-shaped resilient packing 358 is embedded in the periphery of the opening on the end surface of the inlet portion 351A of the housing member 351. When the discharge opening of the accommodating container 330 is closely contacted with the inlet portion 351A, the atmosphere can be shut off by the frame-shaped resilient packing 358, so that moisture-proofing effect can be enhanced.

Figure 15:
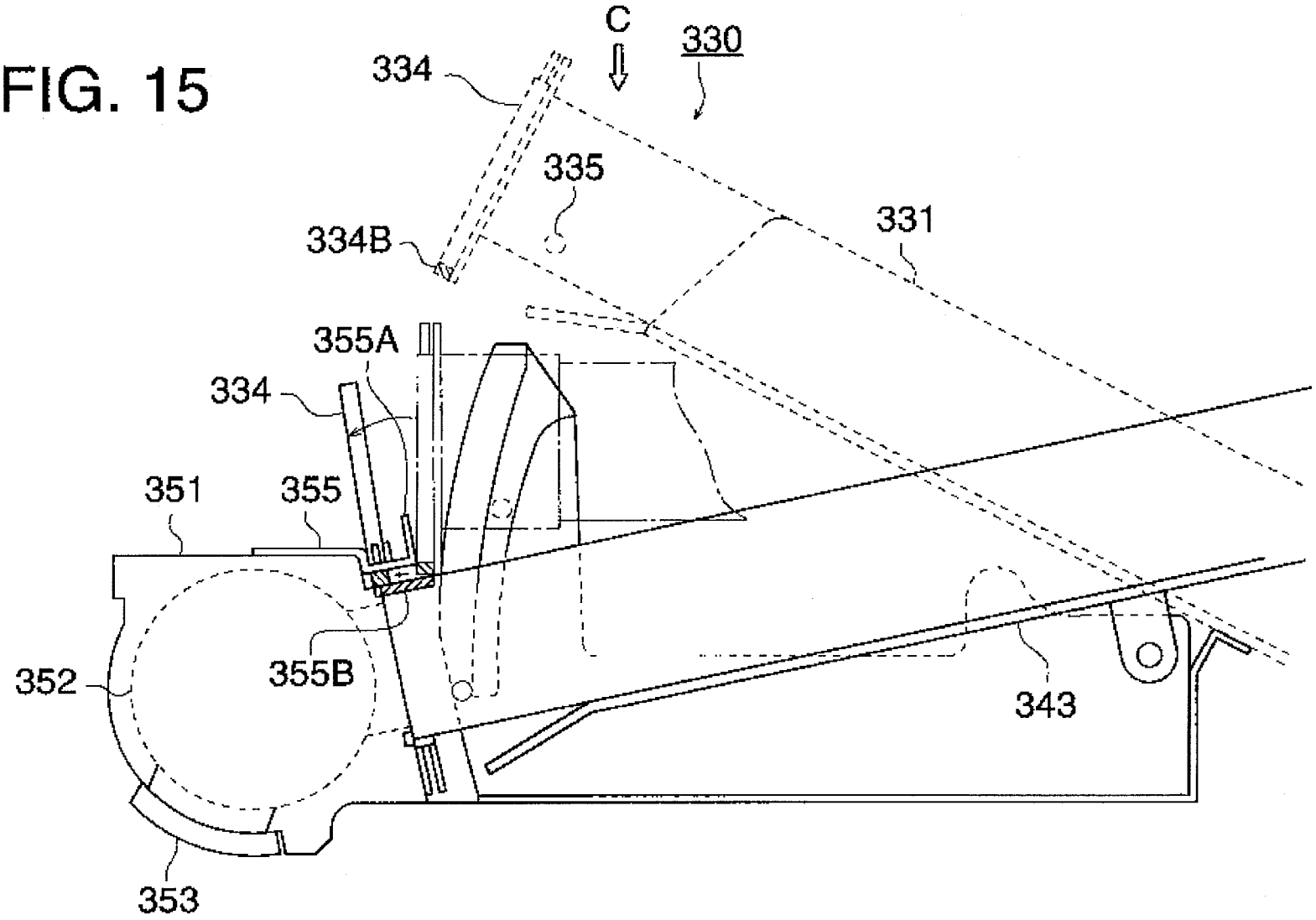
FIG. 15 is a sectional side view for explaining the opening and closing operation of the sliding cover of the accommodating container.

FIG. 15 is a side view for explaining the opening and closing operation of the sliding cover 334 of the accommodating container 33.

At an upper position of the inlet portion of the housing member 351 of the supply means 350, there is provided an opening and closing regulating member 355 for regulating the opening and closing operation of the sliding cover. When the accommodating container 330 provided in the accommodating container charging means 340 is pushed downward from the initial position (shown by a one-dotted chain line) in the direction of arrow C in the drawing, the accommodating container 330 reaches the intermediate position (shown by a one-dotted chain line). Then the descending motion of a protrusion 334B of the sliding cover 334 is stopped by the opening and closing regulating member 355(355B). When the accommodating container 330 is further oscillated, the opening of the outlet opening member 332 of the accommodating container 330 is gradually opened since the sliding cover 334 can not further go downward. When the downward motion of the accommodating container 330 is stopped at a predetermined position, the opening is completely opened, and the solid processing agent tablet J in the first row in the accommodating container 330 is sent to the supply means 350. This complete opening condition is shown by a solid line in the drawing.

When all solid processing agent tablets J in the accommodating container 330 have been successively consumed, a remainder detection signal is generated, and the accommodating container 330 is replaced in accordance with the signal. When the accommodating container 330 is withdrawn backward, the accommodating container 330 and container holding member 3403 are rotated clockwise, so that the left end portion is raised. In this ascending process, the opening and closing regulating member 355A stops the motion of the sliding cover 334, and only the main body composed of the container main body 331 and the cap member 332 is raised, so that the opening portion is closed by the sliding cover 334. Further, in the latter half process in which the accommodating container 330 is raised, the apparatus is returned to the initial condition, which is an upper dead point, while the opening portion is in a closed condition. Therefore, powder of the processing agent in the container can be prevented from being scattered. Even when the container is removed for maintenance while the processing agent remains in the container, the processing agent can not be dispersed since the opening portion is in a closed condition.

Figure 16:
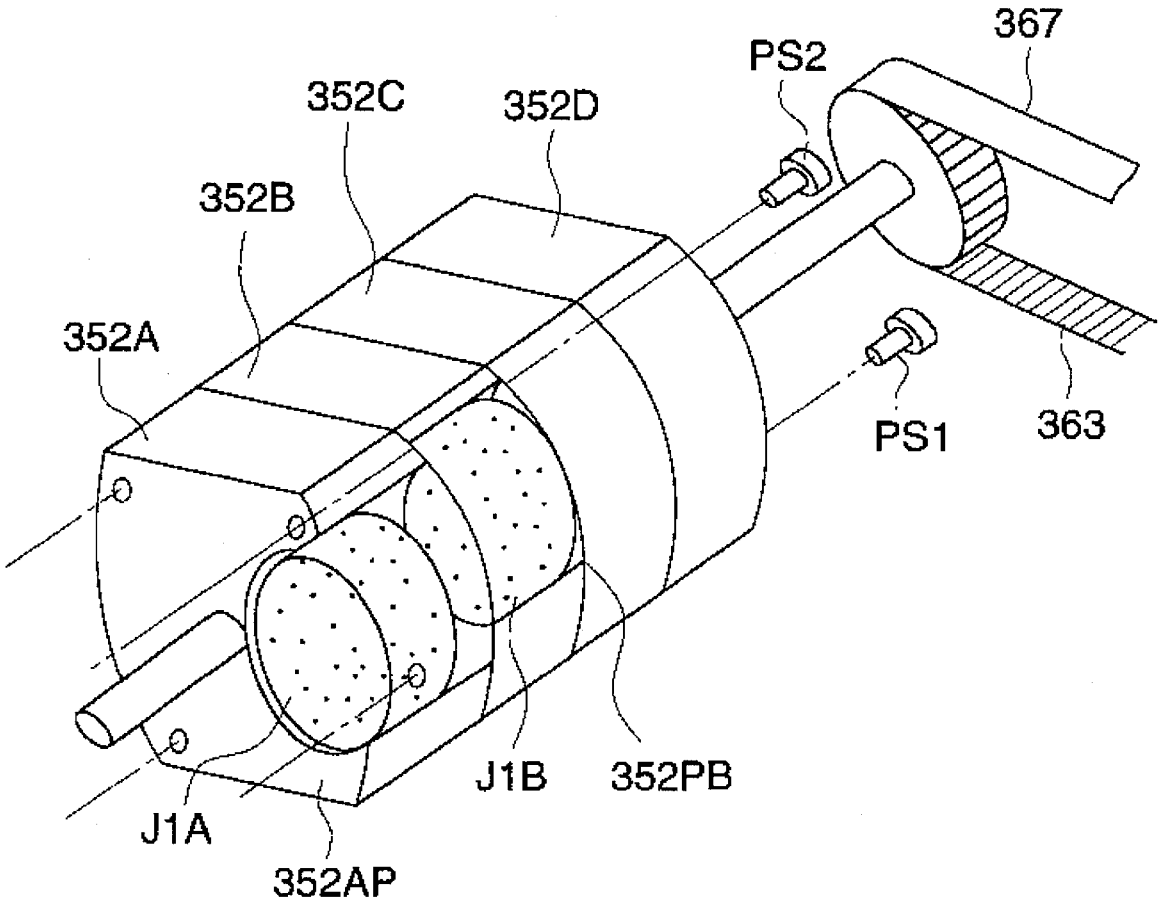
FIG. 16 is a perspective view of the solid processing agent rotary conveyance member of the replenishing means.

FIG. 16 is a perspective view of the processing agent conveyance member (rotor) provided in the supply means 35. The rotor 352 is compose of 4 rotors 352A, 352B, 352C, 352D which are integrally mounted on the same shaft. Each rotor is provided with one pocket (352AP, 352BP, 352CP, 352DP). Each pocket can accommodate one solid processing agent (J1A, J1B, J1C, J1D). The phase of each pocket is shifted. Therefore, when the rotor 352 is rotated by one revolution, the solid processing agent J1A is charged into the first pocket 352A from the discharge opening of the accommodating container 33. Then the solid processing agent tablets are successively charged into the second, third and fourth pockets (352AP, 352BP, . . . ). In the same manner, the solid processing agent tablets are successively discharged outside from the outlet portion 351B.

In each rotor (352A, 352B, 352C, 352D), 4 through-holes are formed. Optical passages of the transmission type optical sensors PS1, PS2 composed of a light emitting element and light receiving element pass through these through-holes. Since the phase of each pocket is shifted, it can be detected whether or not the solid processing agent J is accommodated in each pocket.

Figure 17:
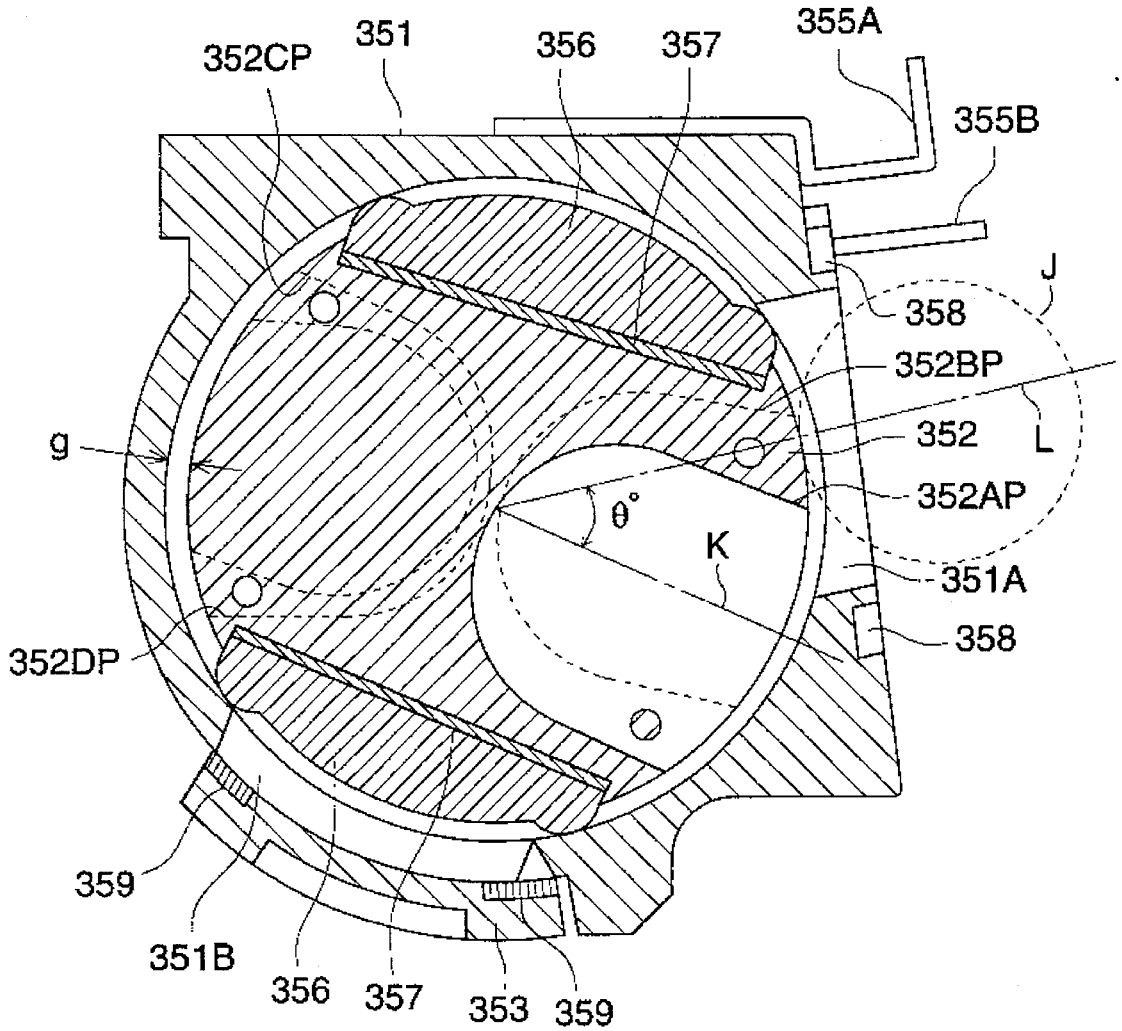
FIG. 17 is an enlarged sectional view of the replenishing means.

FIG. 17 is an enlarged sectional view of the supply means 35. The outer diameter of the rotor 352 is a little smaller than the inner diameter of the housing member 351, so that a small gap "g" is formed. The reason why the gap "g" is formed is described as follows. When the outer and inner diameters are formed to be the same, the solid processing agent J enters clogs the gap. Therefore, the rotor 352 can not be rotated. In order prevent the occurrence of the above problem, the small gap "g" is provided.

Two sliding members 356 are attached to the outer circumference of the rotor 352 through a resilient member 357. When protruded portions formed around the sliding member 356 come into surface-contact with the inner circumferential surface of the housing member 351, a sealed condition can be maintained between the housing member 351 and the rotor 352.

The resilient packing 358 is embedded in the periphery of the opening on the end surface of the inlet portion 351A of the housing member 351. The packing 358 is closely contacted with the discharge opening of the outlet member 332 of the accommodating container 33. Therefore, moisture-proofing effect with respect to the atmosphere (vapor of the processing solution in the processing tank) can be provided.

On the other hand, the outlet portion 351B of the housing member 351 can be opened and closed by the shutter member 353. A resilient packing 359 is stuck on the inner surface of the shutter member 353, so that moisture-proofing effect can be provided to the outlet portion 351B.

The shutter member 353 is linked with the rotation of the rotor 352 and reciprocated along a portion of the outer circumference of the housing member 351. When the rotor 352 starts rotating, the outlet portion 351B is opened. When the rotor 352 is rotated by a half revolution, two solid processing agent tablets J are put into the processing tank 1, and then the outlet portion 351B is closed.

Figure 18:
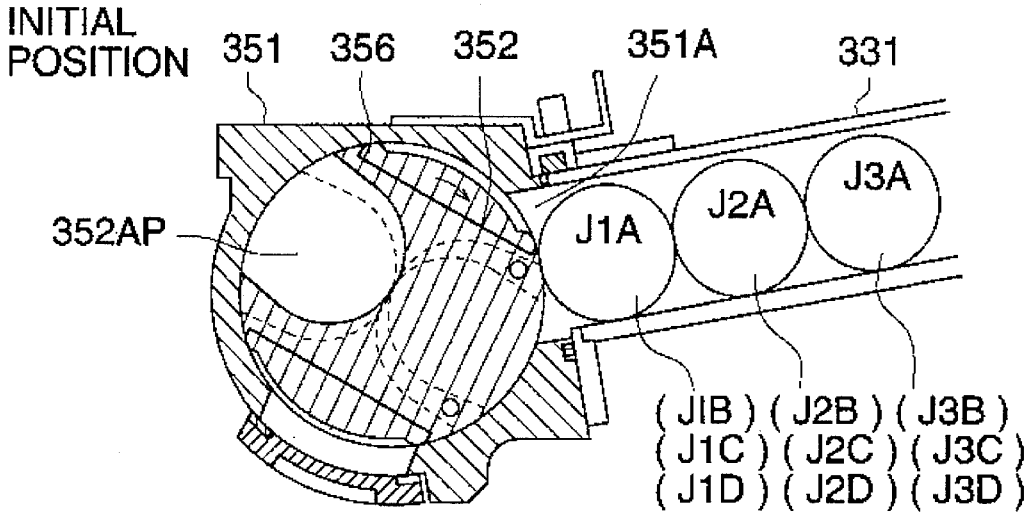
FIGS. 18(A)–18(C) are sectional views showing the process of dropping the solid processing agent by the replenishing means.
Figure 18:
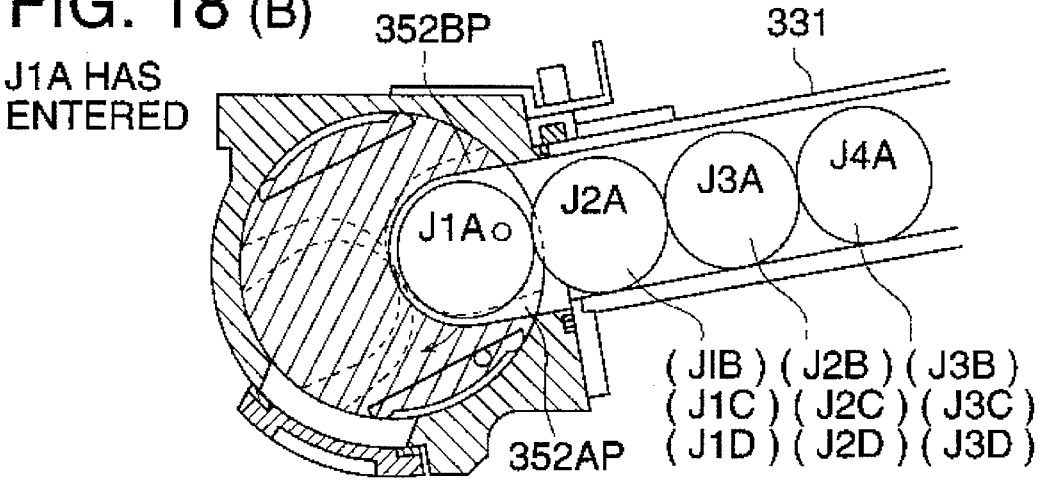
Figure 18:
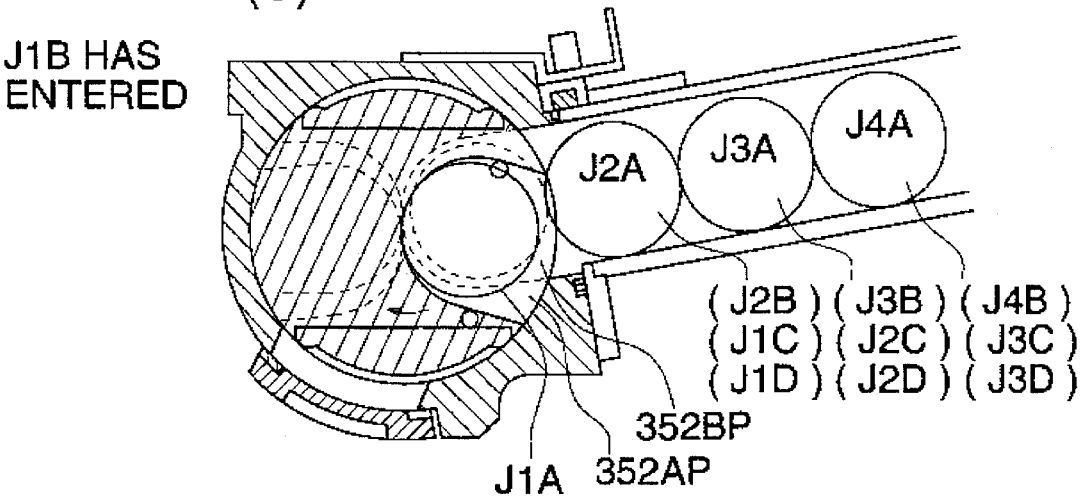

FIGS. 18(A)–18(C) and 19(A)–19(C) are sectional views showing the process of dropping the solid processing agent tablets J by the supply means 35. FIG. 18(A) shows a standby condition in the initial stage. Under this condition, the inlet portion 351A and the outlet portion 351B of the housing member 351 are shielded by the processing agent receiving member 352 and the sliding member 356, so that the atmosphere is prevented from entering. FIG. 18(B) shows a condition in which the rotor 353 is normally rotated and one solid processing agent tablet J1A at the fore end of the row A in the accommodating container 33 is accommodated in the pocket 352AP in the row A of the rotor 352. FIG. 18(C) shows a condition in which the rotor 353 is further rotated normally and the solid processing agent tablet J1B is accommodated in the second pocket 352BP.

Figure 19:
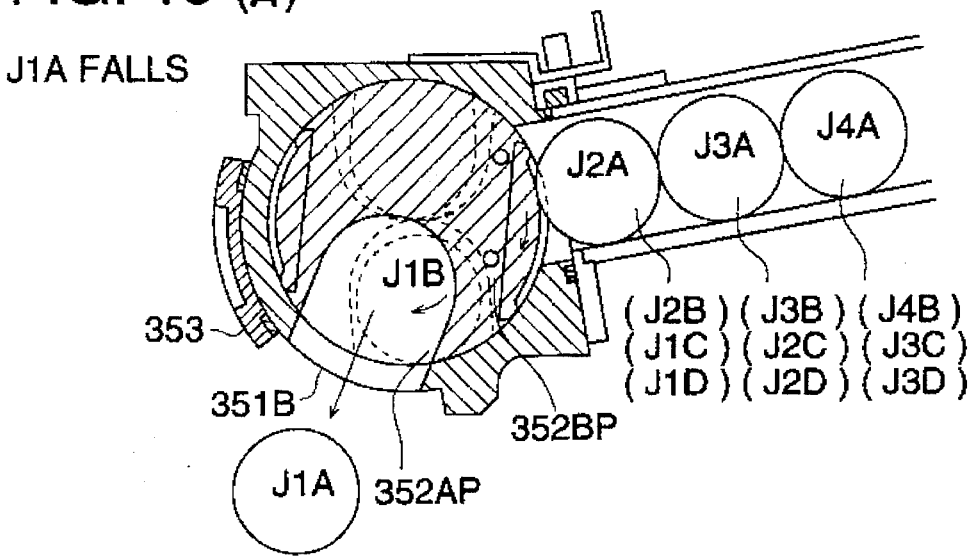
FIGS. 19(A)–19(C) are sectional views showing the process of dropping the solid processing agent by the replenishing means.
Figure 19:
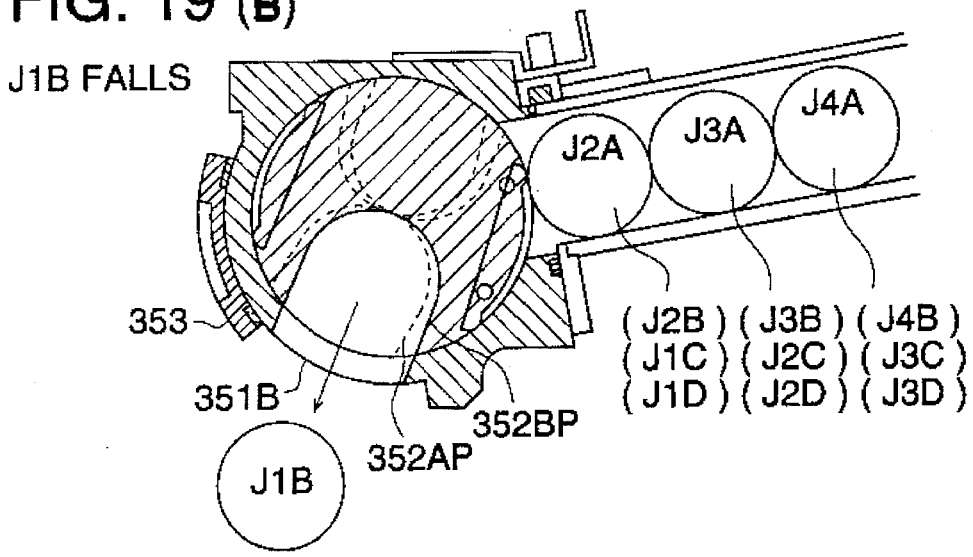
Figure 19:
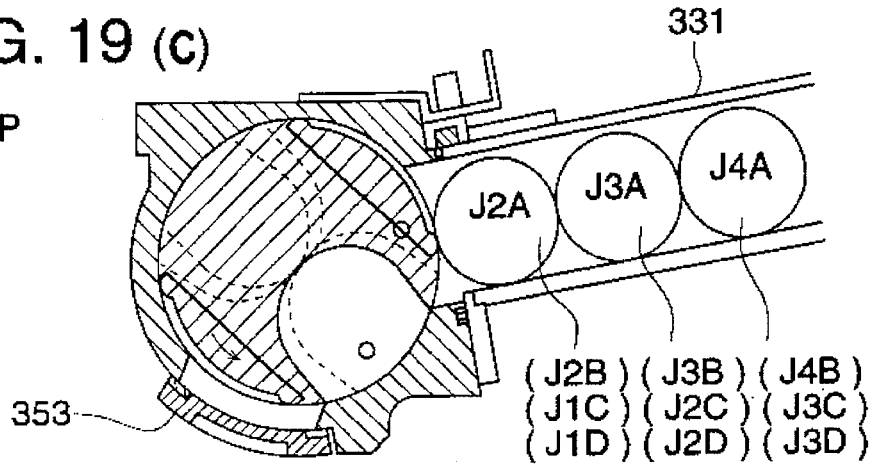

FIG. 19(A) shows a condition in which the rotor 352 is further rotated normally and the pocket 352AP coincides with the outlet portion 351B of the housing member 351, and the first solid processing agent tablet J1A included in the pocket 352AP is dropped. FIG. 19(B) shows a condition in which the rotor 352 is successively rotated in the normal direction and the second solid processing agent tablet J1B is dropped, that is, 2 solid processing agent tablets are dropped. After that, the rotor 352 is reversed, so that it is returned to the initial position and stopped (shown in FIG. 19(C)). In this stopping condition, there is no solid processing agent tablet J in the rotor 352, that is, this stopping condition is a waiting condition. When the shutter member 353 is rotated counterclockwise at the same time, the outlet portion 351B is closed by the shutter member 353, and when 2 solid processing agent tablets J have been dropped, one cycle of operation is completed. In the next cycle of operation, the solid processing agent tablets J1C, J1D are successively charged and dropped with respect to the third pocket 352CP in the row C and the fourth pocket 352DP in the row D. After that, the opening portion 351B is closed by the shutter member 353 again. In this way, when the rotor 352 is rotated by a half revolution, 2 solid processing agent tablets are successively dropped. After dropping, the outlet portion 351B is closed by the shutter member 353 which has been returned.

Referring to FIG. 14, the drive means of the solid processing agent replenishing device of the present invention will be explained as follows.

The drive means 360 of the present invention is disposed under the accommodating container charging means 340. A timing belt 363 is wound around a timing pulley 362 mounted on the drive shaft of the motor 361. The timing belt 363 rotates a pulley 367 mounted on the rotational shaft of the rotor 352, through pulleys 364, 365 and a tension pulley 366.

A cam 368 is mounted on the same shaft as that of the pulley 365. On the other hand, a claw portion 3401F is fixed onto the bottom surface of the container holding member 3403 and engaged with the cam 368.

When the pulley 365 and cam 368 are rotated by the drive of the motor 361, a protruding portion of the cam 368 pushes up the claw portion 340F, and a cutout portion of the cam 368 is separated from the claw portion 3401F. When the cam 368 is rotated, shocks are repeatedly given to the claw portion 341C and the container holding member 343 formed integrally with the claw portion 3401F. Due to the foregoing, the solid processing agent tablet J in the accommodating container 330 rolls to the discharge port along an inclined surface of the package body 331. The rolling motion of the solid processing agent tablet J is not stopped halfway.

A cutout disk 369 having 2 cutout portions is integrally mounted on the same shaft as that of the pulley 365. When the photo-interrupter type optical sensor PS5 detects the passage of the cutout portion, a positional detection signal is emitted, and one cycle stopping operation of the rotor 352 is controlled.

As explained above, 4 solid processing agent tablets J are successively dropped. Accordingly, when a chute 29 through which only one solid processing agent tablet J can pass is provided under the supply means 34, the tablet J can be easily dropped even in a small space above the dissolution tank 2, and further the filter 22 can be easily replaced. The reason why the phase of the solid processing agent J1A and that of the solid processing agent J1B are shifted is described as follows.

(1) It is an object to prevent two solid processing agent tablets J from being engaged with each other in the chute 29. In this way, the two solid processing agent tablets J can be prevented from being caught by the chute 29.

(2) It is an object to independently detect the solid processing agent tablets J with the sensors PS1, PS2 in order to check the necessity of replenishment of the solid processing agent tablets J. In this connection, the number of the solid processing agent tablets J to be dropped in one cycle is not limited to 2, but 4 solid processing agent tablets J may be dropped while the rotor is rotated by one revolution.

Figure 20:
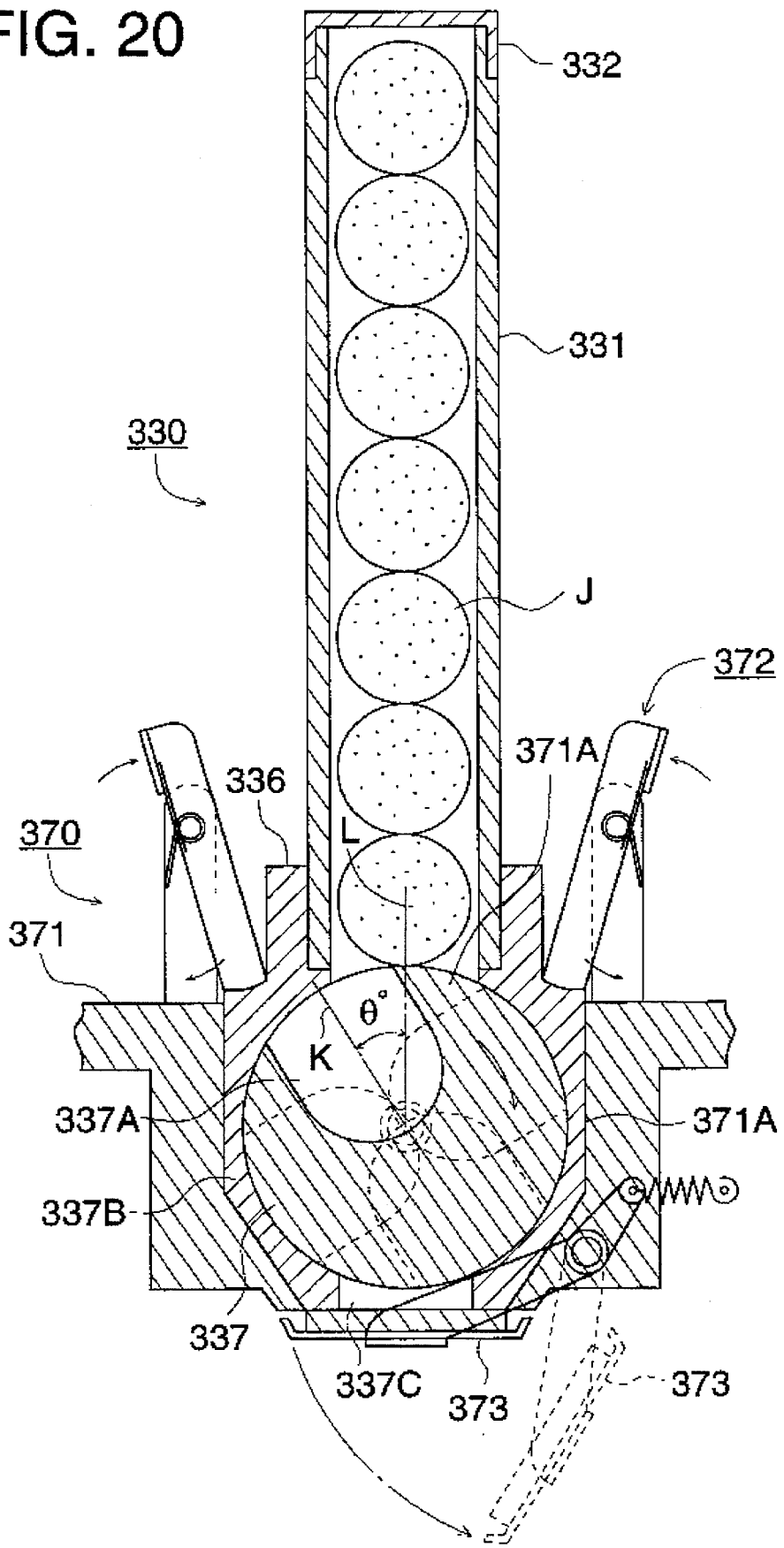
FIG. 20 is a sectional front view of the accommodating container of another example of the present invention.

FIG. 20 is a sectional front view showing another example in which the accommodating container 330 is attached and fixed to the supply means 370. In FIG. 20, like reference characters are used to indicate like parts. Only different points from the above example will be explained here.

The accommodating container 330 includes a container body 331 in which the solid processing agent is accommodated, and the container body 331 is integrally attached to the supply main body 336. A rotational conveyance member (rotor) 337 capable of rotating is provided in the supply main body 336. The accommodating container 330 is detachably attached to the attaching section 371A of the supply main body 371. A clamp means 372 for fixing the accommodating container 330 is provided in the upper portion of the supply main body 371. The container body 331 of the accommodating container 330 may be vertically provided as illustrated in the drawing, or alternatively the container body 331 of the accommodating container 330 may be diagonally provided. In the upper portion of the supply main body 371, there are provided an inlet opening 371A for receiving the solid processing agent J and sending it to the receiving portion 337A of the rotational conveyance member 337, a cylindrical inner wall portion 337B slidably coming into contact with the outer circumference of the rotational conveyance member 337, and an outlet opening 337C for discharging the solid processing agent J when the rotational conveyance member 337 is rotated. The outlet opening 337C is opened and closed by the shutter cover 373 capable of being oscillated.

Before the supply of the solid processing agent J, the center line K of the receiving section 337A formed in the rotational conveyance member 337 is inclined by angle θ with respect to the center line L of the solid processing agents J aligned in the container body 331. Therefore, the lead solid processing agent J in the container body 331 comes into contact with the outer circumferential wall surface of the rotational conveyance member 337. Accordingly, it is impossible for the lead solid processing agent J to advance into the receiving section 337A.

Figure 21:
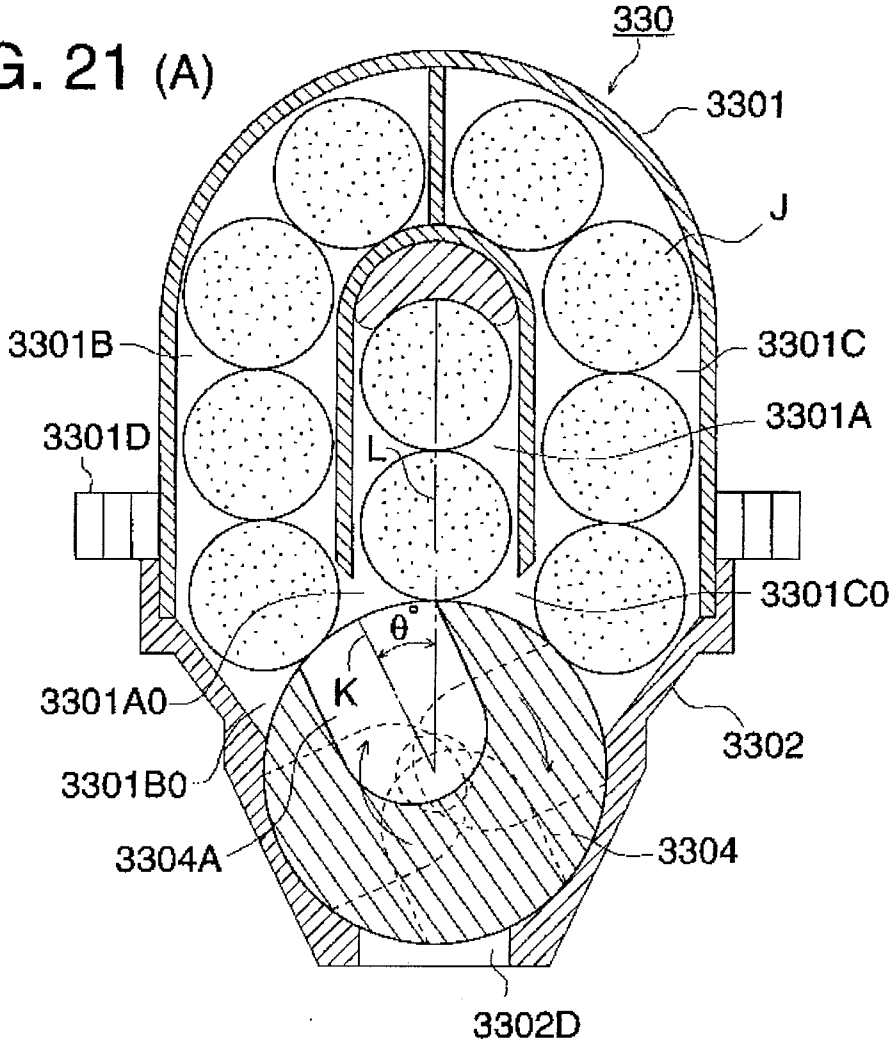
FIG. 21 shows front and side sectional views of the accommodating container of another example of the present invention.
Figure 21:
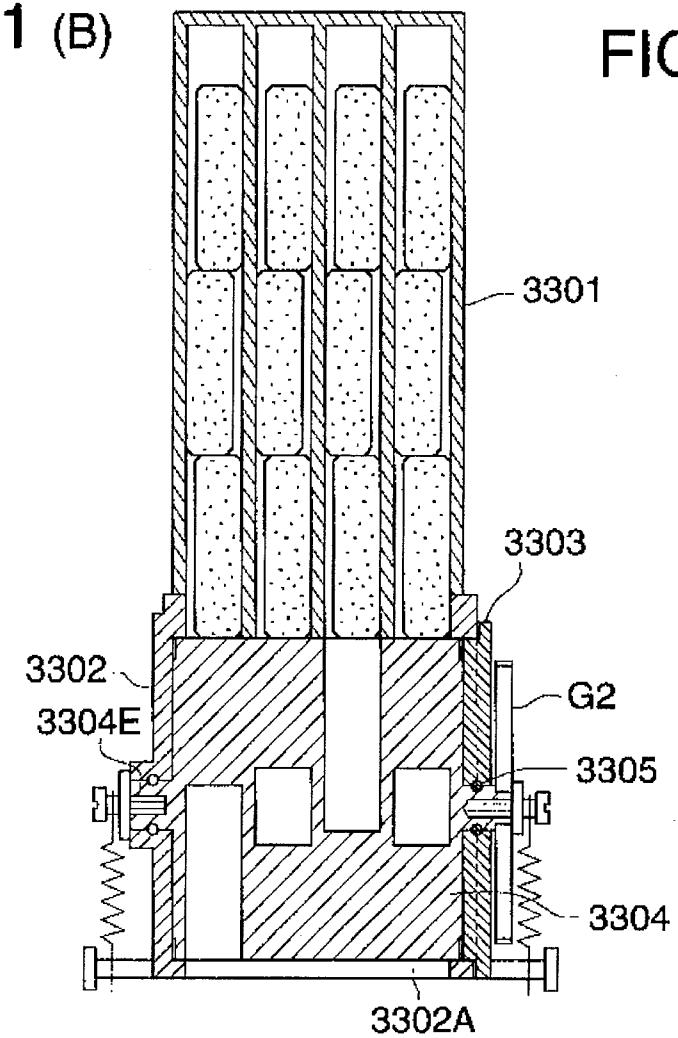

FIG. 21 is a view showing the accommodating container (cartridge) 330 for accommodating the tablet type solid processing agent J. FIG. 21(A) is a sectional front view, and FIG. 21(B) is a sectional side view.

The accommodating container 330 is composed of two members. That is, the accommodating container 330 includes: a first container body (upper body) 3301 for accommodating a plurality of tablet type solid processing agents J; and a second container body (lower body) 3302 for accommodating and rotatably supporting the rotational conveyance member 3304, wherein the second container body (lower body) 3302 is integrally arranged below the upper body 3301 by means of screws. After the rotational conveyance member 3304 has been attached to the lower body 3302, it is covered with the cover member 3303 so that the lower body 3302 is airtightly maintained in a moisture-proof condition. Rotational shaft sections 3304E provided at both ends of the rotational conveyance member 3304 are rotatably supported by the bearing section of the lower body 3302 and that of the cover member 3303. In this connection, the bearing section of the cover member 3303 is provided with an O-ring 3305, so that the outside air is prevented from getting into the rotational conveyance member 3304.

Figure 4:
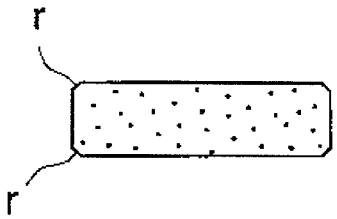
FIGS. 4(A)–4(E) show sectional and perspective views of various configurations of the tablet type solid processing agent.
Figure 4:
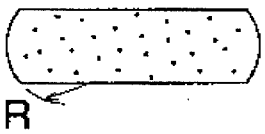
Figure 4:
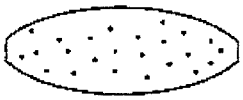
Figure 4:
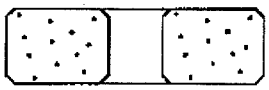
Figure 4:
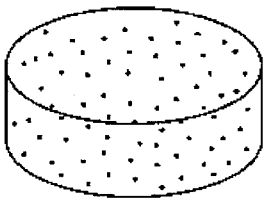

As illustrated in FIG. 21(A), a top portion of the outer wall of the upper body 3301 is formed circular, and the inside of the upper body 3301 is partitioned by a U-shaped bulkhead. To be specific, the inside of the upper body 3301 is divided into a central chamber 3301A, left chamber 3301B and right chamber 3301C. The lower portion of each chamber is open, and there are provided outlet openings 3301AO, 3301BO and 3301CO at the lower portions of the chambers. In the upper body 3301 illustrated in FIG. 21(A), 2 tablets of solid processing agent J are accommodated in the central chamber 3301A, and 4 tablets of solid processing agent J are accommodated in the left chamber 3301B, and 4 tablets of solid processing agent J are accommodated in the right chamber 3301C. Therefore, 10 tablets of solid processing agent J are accommodated in total. As described above, 10 tablets of solid processing agent J are arranged on the same plane in one accommodating chamber. As illustrated in FIG. 21(B), 4 accommodating chambers are stacked through the bulkheads in parallel in the thickness direction of the tablet of solid processing agent J. Since 10 tablets are accommodated in each chamber, 40 tablets of solid processing agent J are accommodated in the accommodating container 330 in total.

In the lower body 3302, there is provided a discharge opening 3302A for discharging the solid processing agent J. A tablet of solid processing agent J dropped from each of the chambers 3301A, 3301B, 3301C is received by the rotational conveyance member (rotor) 3304, which is supported by the rotational shaft 3304E. Reference numeral 3304A denotes a U-shaped recess which functions as a receiving section for receiving the tablet of solid processing agent J.

In FIG. 21(A), before the supply of the solid processing agent J, the center line K of the receiving section 3304A is inclined by angle θ with respect to the center line L of the central chamber 3301A of the container body 3301. Therefore, the lead solid processing agent J in the container body 3301 comes into contact with the outer circumferential wall surface of the rotational conveyance member 3304. Accordingly, it is impossible for the lead solid processing agent J to advance into the receiving section 3304A. In the same manner, other receiving sections of the rotational conveyance member 3304 prevent tablets of solid processing agent J from getting into the receiving sections.

Figure 22:
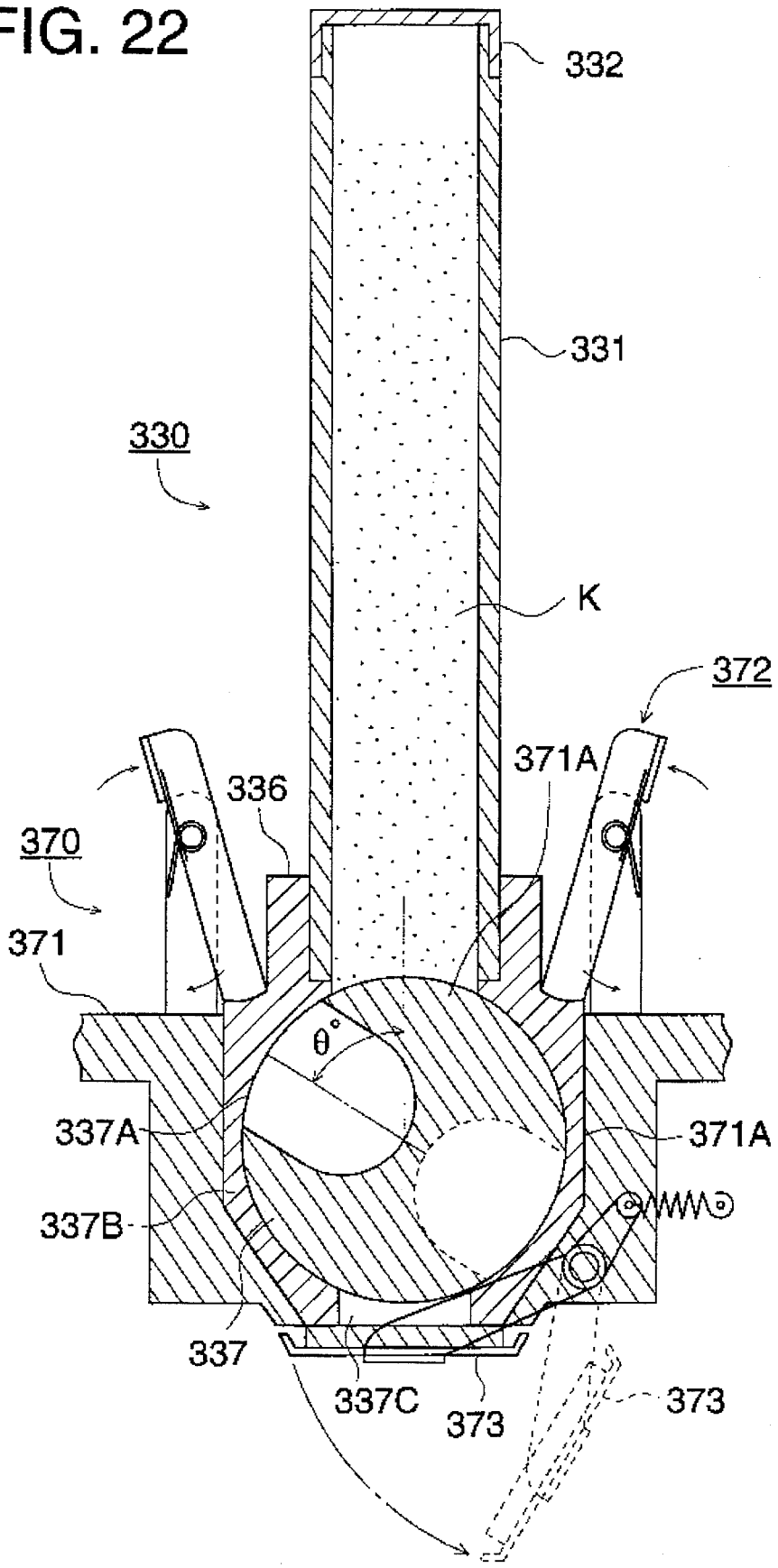
FIG. 22 is a sectional view showing an accommodating container and supply means.

In the above example, the tablet type solid processing agent J is taken as an example of the solid processing agent. However, it should be noted that the present invention is not limited to the specific example of the tablet type solid processing agent J. It is possible to apply the present invention to the powder type processing agent and the granular type processing agent. FIG. 22 is a view showing an example in which the accommodating container and supply means used for the tablet type solid processing agent illustrated in FIG. 20 are modified so as to be used for the granular type processing agent.

As described above, according to the solid processing agent replenishing device of the present invention, when the device is in a stopping condition in which the accommodating container is attached to the supply means, or when the accommodating container is removed from the supply means, the solid processing agent is not left in the solid processing supply means. Accordingly, high moisture-proof effect of the solid processing agent can be provided, and workability can be enhanced when the accommodating container is attached to and detached from the device. Therefore, tablets of solid processing agent do not absorb moisture so that they are not denatured, and a predetermined amount of solid processing agent can be positively fed to the processing tank, and stable photographic performance can be provided.

The solid processing agent held in the accommodating container does not absorb moisture in the process of replenishment, so that a perfect moisture-proof condition can be maintained and quality assurance can be accomplished.

What is claimed is:

1. An apparatus for supplying a solid processing agent to a processing tank of a silver halide photographic material processing apparatus, comprising:

an accommodation container in which a solid processing agent is stored, the accommodation container having an opening section through which the solid processing agent is discharged from the accommodation container; and a supply device on which the accommodation container is detachably mounted, the supply device including:

a housing;

an inlet opening provided for the housing, the inlet opening communicating with the opening section of the accommodation container mounted on the supply device so that the solid processing agent is received from the opening section of said accommodation container into said housing through the inlet opening;

an outlet opening provided for said housing, wherein the solid processing agent is dropped from inside the housing to a processing tank through the outlet opening;

a conveyance member movably retained in the housing so as to convey the solid processing agent in the housing from the inlet opening to the outlet opening, and a shutter member movably coupled to an outer periphery of the housing so as to move between open and closed positions that, respectively, open and close the outlet opening, the shutter member being actuated by movement of the conveyance member so that upon the solid processing agent being conveyed by the conveyance member and positioned at the outlet opening, the shutter member is moved to the open position, and when the solid processing agent is not positioned at the outlet opening, the shutter member is enabled to move to the closed position.

2. The apparatus of claim 1, wherein when the solid processing agent is not needed to be supplied to the processing tank, the supply device blocks the solid processing agent from entering the inlet opening so as not to receive the solid processing agent in the supply device, and when the solid processing agent is needed to be supplied to the processing tank, the supply device receives the solid processing agent through the inlet opening and the conveyance member drops the solid processing agent through the outlet opening into the processing tank so that the solid processing agent does not remain in the supply device while the solid processing agent is not needed to be supplied to the processing tank.

3. The apparatus of claim 2, wherein the supply device comprises a driving device to move or stop the conveyance member, and wherein when the solid processing agent is not supplied to the processing tank, the conveyance member is stopped at a position in the vicinity of the inlet opening section so as to block the solid processing agent.

4. The apparatus of claim 3, wherein the conveyance member is a rotary conveyance member rotatable on a rotation axis thereof and having a recess on a peripheral surface thereof, wherein the recess is shaped to receive the solid processing agent therein.

5. The apparatus of claim 4, wherein the inlet opening is disposed on a first position around the rotary conveyance member so that when the recess of the rotary conveyance member comes to the first position with the rotation of the rotary conveyance member, the solid processing agent is received in the recess from the inlet opening.

6. The apparatus of claim 5, wherein the outlet opening is disposed on a second position around the rotary conveyance member so that when the recess of the rotary conveyance member comes to the second position with the rotation of the rotary conveyance member, the solid processing agent is discharged from the recess and is dropped in the processing tank through the outlet opening.

7. The apparatus of claim 6, wherein during a rotation period of the rotary conveyance member, the recess passes the first position and the second position so that the solid processing agent is received in the recess and then discharged from the recess during the rotation period, and during a stop period, the recess is positioned not to receive the solid processing agent from the inlet opening.

8. The apparatus of claim 1, wherein the accommodation container includes a shielding cover member to open or close the opening section of the accommodation container.

9. The apparatus of claim 8, wherein when the accommodation container is mounted on the supply device, the shielding cover member opens the opening section, and when the accommodation container is detached from the supply device, the shielding cover member closes the opening section.

10. The apparatus of claim 1, wherein the supply device further includes a holding member to detachably hold the accommodation container.

11. The apparatus of claim 9, wherein the holding member holds the accommodation container in such manner that a processing agent stored in the accommodation container is discharged through the opening section by gravity.

12. The apparatus of claim 1, wherein the shutter member is moved interlockingly with the rotation of the rotary conveyance member so that when the recess comes to the second position so as to discharge the solid processing agent through the outlet opening, the shutter member opens the outlet opening.

13. The apparatus of claim 1, wherein the solid processing agent is a tablet type solid processing agent.

14. The apparatus of claim 1, wherein the supplying apparatus is provided on the silver halide photographic material processing apparatus.

15. The apparatus of claim 1, wherein the supplying apparatus is provided in the vicinity of the silver halide photographic material processing apparatus.

* * * * *